US005348372A

United States Patent [19]

Takamatsu et al.

[11] Patent Number: 5,348,372

[45] Date of Patent: Sep. 20, 1994

[54] TILTING CONTROL ASSEMBLY FOR CHAIR

[75] Inventors: Shunichi Takamatsu; Hirozi Kubo; Katsunori Hama; Hiroshi Iwabuchi, all of Osaka, Japan

[73] Assignee: Itoki Crebio Corporation, Osaka, Japan

[21] Appl. No.: 959,628

[22] Filed: Oct. 13, 1992

[30] Foreign Application Priority Data

Oct. 22, 1991 [JP] Japan ..... 3-086141[U]
Jul. 28, 1992 [JP] Japan ..... 4-201490

[51] Int. Cl.[5] ..... A47C 1/02

[52] U.S. Cl. ..... 297/306; 297/304; 297/354.12

[58] Field of Search ..... 297/300, 306, 304, 354.12, 297/285

[56] References Cited

U.S. PATENT DOCUMENTS

| | | | |
|---|---|---|---|
| 4,200,332 | 4/1980 | Brauning | 297/354.12 |
| 4,479,679 | 10/1984 | Fries | 297/300 |
| 4,494,795 | 1/1985 | Roossien | 297/354.12 |
| 4,938,531 | 7/1990 | Fogarassy | 292/300 |
| 4,962,962 | 10/1990 | Machate | 297/300 |
| 5,046,780 | 9/1991 | Decker et al. | 297/302 |
| 5,080,318 | 1/1992 | Takamatsu et al. . | |
| 5,160,184 | 11/1992 | Faiks | 297/304 |

FOREIGN PATENT DOCUMENTS

| | | | |
|---|---|---|---|
| 0131554 | 1/1985 | European Pat. Off. | 297/300 |
| 0205097 | 6/1986 | European Pat. Off. . | |
| 0435297 | 7/1991 | European Pat. Off. . | |
| 2647409 | 7/1977 | Fed. Rep. of Germany . | |
| 3741472 | 6/1989 | Fed. Rep. of Germany . | |

*Primary Examiner*—P. Austin Bradley
*Assistant Examiner*—James Miner
*Attorney, Agent, or Firm*—Michael D. Bednarek

[57] ABSTRACT

The present invention provides a tilting control assembly for a chair. The chair comprises a support device, a seat supported above the support device, and a seat back arranged behind the seat to tilt rearwardly. The tilting control assembly comprises a tilting control spring device for elastically supporting the seat back against rearward tilting thereof via a load applying member, a displacing mechanism responsive to a downward load applied to the seat for causing the load applying member to move relative to the spring device, and a lock device for preventing the load applying member from moving reversely relative to the spring device when the seat back is rearwardly tilted.

10 Claims, 27 Drawing Sheets

21
22
25c
25a
25b
25
25c
26
24
20
30
30a
28a
30
30a
23
31
32
28
18
19
28a
28
14b
19a
14b
14a
14a'
29
14a
14a'
13a
13
13'

21
9
55
22
23
20
18
4c
19a
6
6a
4b
19
8
2
13
7b'
24
30
3
25c
64
25
25a
14
4
25b
26
14b
10
4b
29
38
31
e1
32
7a
11a
7

25c
25b
22
24
25b
XII
25c
14b
26
12
10
25a
30
30a
30
28a
28
13
14
7a
13a
59
7b
63
57
65
60
56
66
66
58
62
67
67a
64
62
XII 14b
14c
18
9
8
14
13
55b
7a
15a
13a
55
13a
6a
6
7b
7
59
60
55a
56
67
58
66
62
67a
39
2

Fig. 18
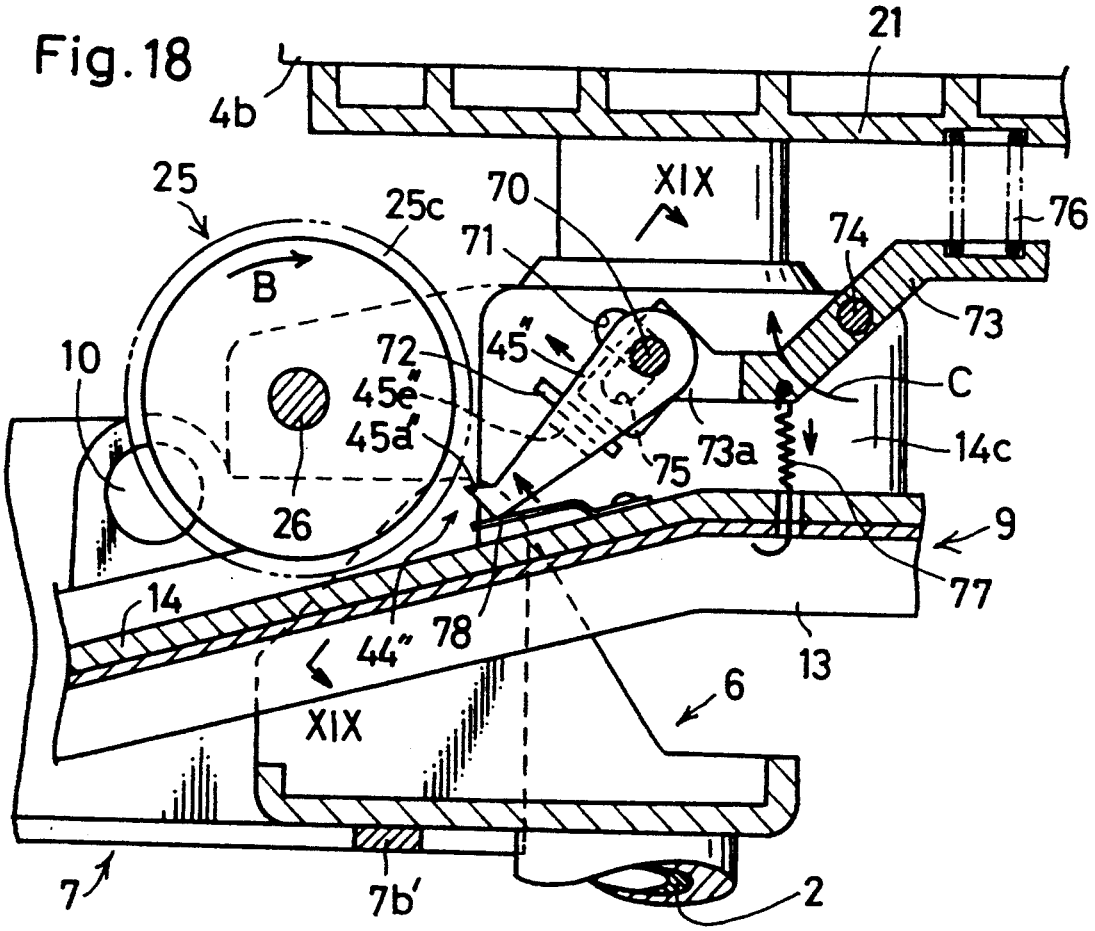
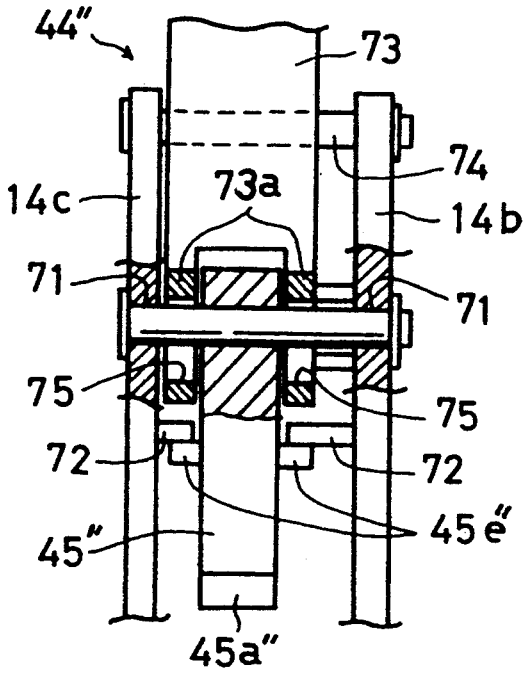
Fig. 19

TILTING CONTROL ASSEMBLY FOR CHAIR

BACKGROUND OF THE INVENTION

1. Field of the Invention

This invention relates generally to chairs for use in offices for example. More particularly, the invention relates to a chair of the type wherein at least the seat back are designed to be tiltable rearwardly against a spring or springs.

2. Description of the Prior Art

There have been proposed various types of tiltable chairs wherein at least one of the seat and the seat back is tiltable against a tilting control spring or springs. The most typical is a rocking chair wherein the seat is rearwardly tiltable together with the chair back. Such a chair enables the user to assume a relaxing posture occasionally during desk work for example.

U.S. Pat. No. 5,080,318 discloses a chair tilting control assembly wherein the supportive force of a tilting control spring device is automatically adjusted to suit the weight of any user, so that the spring device provides a stronger support for a heavier user than for a lighter user. Another chair tilting control assembly having similar automatic adjustment (though slightly different in the operating principle) is also disclosed in European Patent Application Laid-open No. 0435297.

According to either one of these patent documents, when the user sits on the chair, the seat moves downward against a weight responsive spring device which deforms proportionally to the user's weight. The downward movement of the seat results in a corresponding movement of a displacing mechanism for adjusting the supportive force of the tilting control spring device to suit the user's weight. Thus, when the user subsequently assumes a reclining posture, the seat back tilts rearwardly against the thus adjusted tilting control spring device, so that the user can enjoy comfortable reclining.

In reality, however, if the user leans on the seat back, a part of the user's weight is taken by the seat back. As a result, the seat is moved up slightly by the weight responsive spring device, thereby causing a slight returning movement of the displacing mechanism. Thus, the supportive force or ability of the tilting control spring device deviates slightly from the previously adjusted value, consequently failing to provide comfortable tilting control. Obviously, the degree of such deviation increases as the user reclines more.

SUMMARY OF THE INVENTION

It is, therefore, an object of the present invention to provide a chair tilting control assembly which is capable of automatically adjusting the tilting support ability of the tilting control spring or springs and which is further capable of holding the thus adjusted tilting support ability at least at the time of rearwardly tilting a seat back.

According to the present invention, there is provided a tilting control assembly for a chair, the chair comprising: support means; a seat supported above the support means; and a seat back arranged behind the seat to tilt rearwardly; the tilting control assembly comprising: tilting control spring means for elastically supporting the seat back against rearward tilting thereof via load applying means; and displacing means responsive to a downward load applied to the seat for causing relative displacement between the tilting control spring means and the load applying means in a manner such that the tilting control spring means provides a progressively larger supportive force as the downward load increases; wherein the tilting control assembly further comprises lock means for preventing reverse relative movement between the tilting control spring means and the load applying means at least while the seat back is rearwardly tilted.

The lock means may be designed to actuate only when the seat back starts tilting rearward. Alternatively, the lock means may be designed to actuate immediately when the downward load is applied to the seat. In the latter case, the lock means allows forward relative movement between the tilting control spring means and the load applying means but prevents reverse relative movement between these two components.

Other objects, features and advantages of the present invention will be fully understood from the following detailed description of the preferred embodiments given with reference to the accompanying drawings.

BRIEF DESCRIPTION OF THE DRAWINGS

In the accompanying drawings:

FIG. 18 is a sectional view similar to FIG. 16 but showing a lock device according to a third embodiment of the present invention;

FIG. 19 is a sectional view taken along lines XIX—XIX in FIG. 18;

DETAILED DESCRIPTION OF PREFERRED EMBODIMENTS

The accompanying drawings show various embodiments of the present invention, but these embodiments are not limitative of the scope provided by the invention. Now, these embodiments are described one by one.

EMBODIMENT 1

FIGS. 1 through 16 show a rocking chair according to a first embodiment of the present invention.

Figure 2:
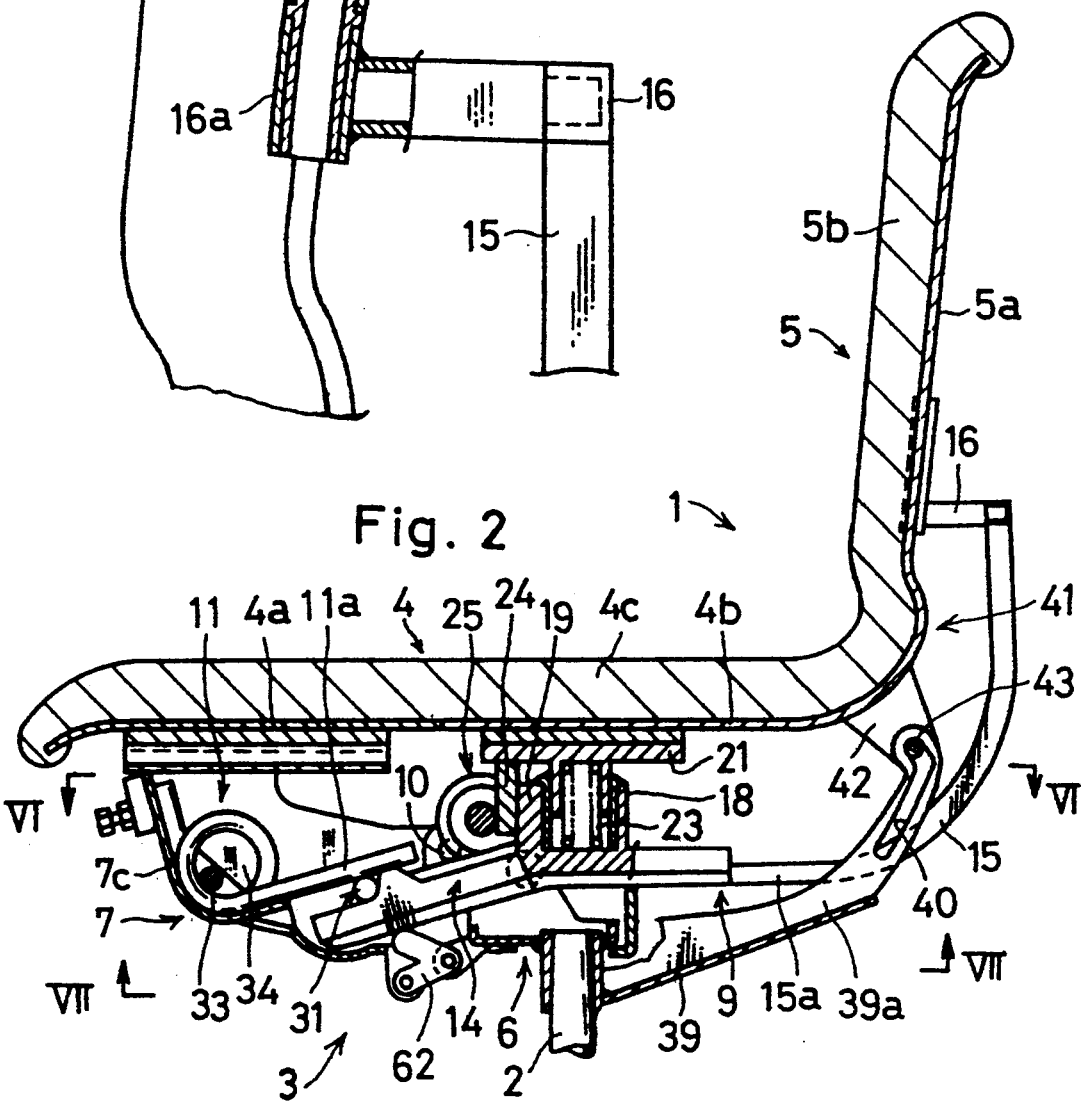
FIG. 2 is a sectional side view showing the entirety of the same rocking chair.

As shown in FIG. 2, the rocking chair of this embodiment, which is generally designated by reference numeral 1, mainly comprises a support device 3 mounted to the upper end of a chair leg post 2, and a seat 4 mounted on the support device 3, and a seat back 5 integral with the seat 4.

Figure 5:
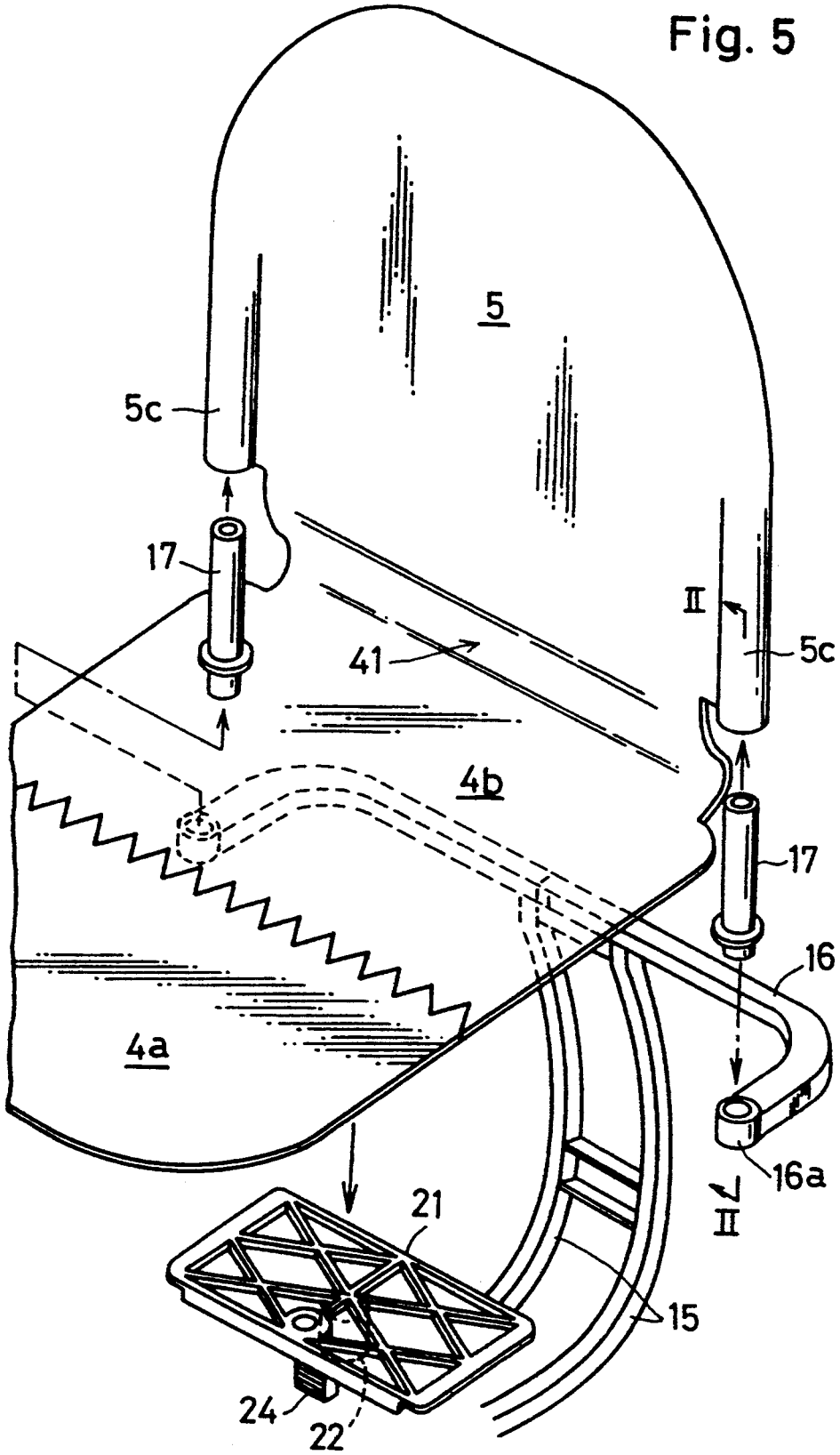

As best shown in FIGS. 2 and 5, the seat 4 includes a seat front carrier plate 4*a*, a seat tail carrier plate 4*b*, and a seat cushion 4*c* attached on the respective carrier plates 4*a*, 4*b*. According to the illustrated embodiment, the respective carrier plates 4*a*, 4*b* respectively have mating serrations (FIG. 5). Both of the carrier plates 4*a*, 4*b* may be made of synthetic resin, metal or other suitable material. The cushion 4*c* may be made of rubber or other elastic material.

As also shown in FIGS. 2 and 5, the seat back 5 includes a back carrier plate 5*a* integral with the seat tail carrier plate 4*b*, and a back cushion 5*b* integral with the seat cushion 4*c*. Of course, the seat back 5 may be separably connected to the seat 4.

As shown in FIGS. 2, 3, 6 and 8, the support device 3 comprises a fixed frame 6 attached to the upper end of the chair leg post 2, and a forwardly pivotal frame 7 attached to the fixed frame 6. The fixed frame 6 is upwardly open, and has a pair of upturned side walls 6*a* and a bottom wall 6*b* (see FIG. 12). The pivotal frame 7, which is also open upwardly, has a pair of upturned side walls 7*a*, a bottom wall 7*b* (FIG. 8), an upturned front wall 7*c*, and a pair of side flanges 7*d* extending laterally outward from the respective side walls 7*a*. The side walls 7*a* of the pivotal frame 7 are connected to the side walls 6*a* of the fixed frame 6 by a pair of first horizontal pivots 8, and the bottom wall 7*b* of the pivotal frame has a tail portion 7*b*′ engaging the bottom wall 6*b* of the fixed frame 6 from below. Thus, the pivotal frame 7 is pivotable only forwardly about the first horizontal pivots 8.

Figure 3:
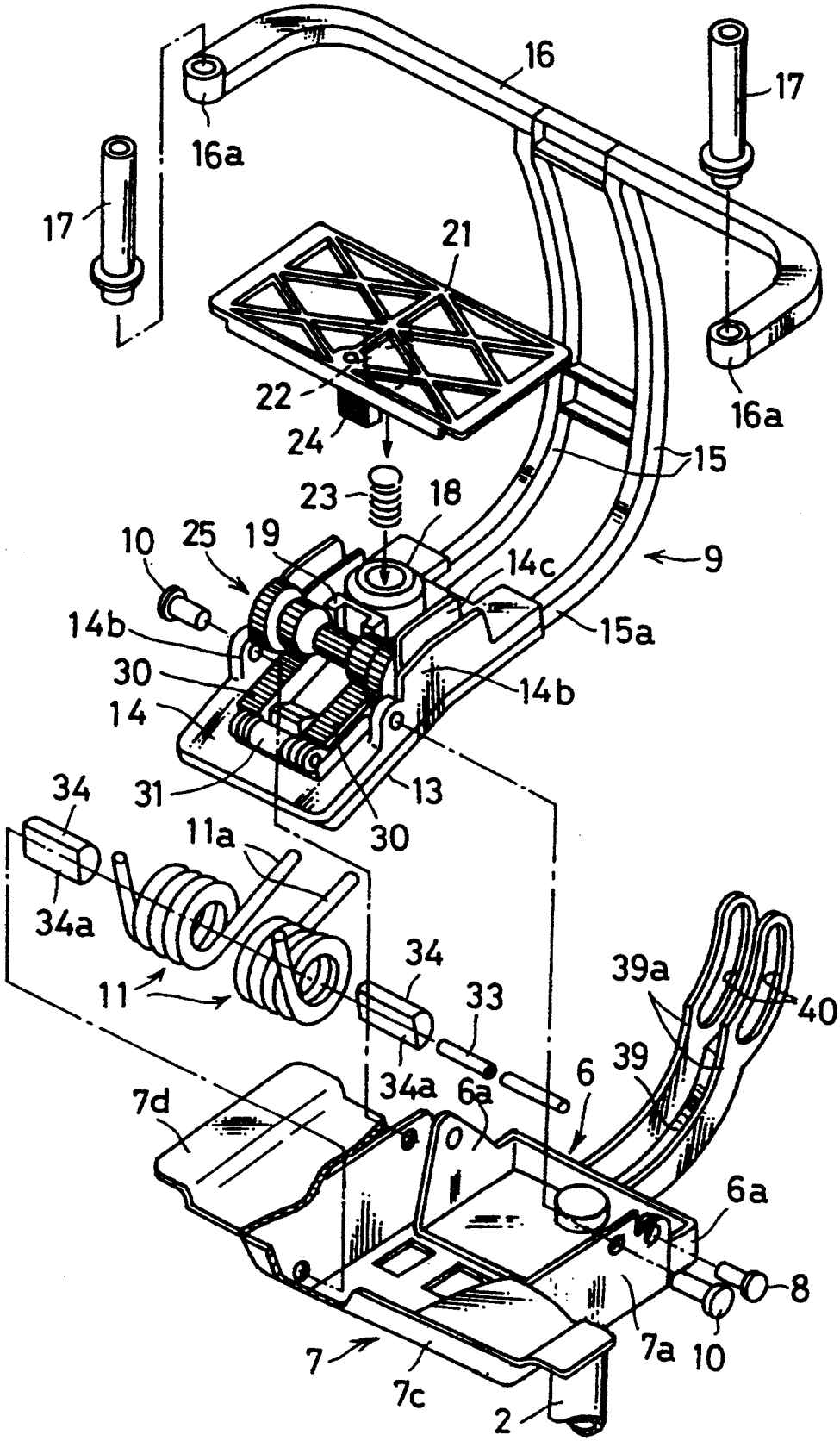
FIGS. 3 to 5 are perspective views showing principal portions of the same rocking chair in an exploded state.

As shown in FIGS. 2 and 3, the seat back 5 is connected to a tiltable member 9 which is pivotable about a pair of second pivots 10. The details of the tiltable member 9 will be described hereinafter. The pivotal movement of the tiltable member 9 is elastically controlled by a pair of tilting control springs 11.

Figure 6:
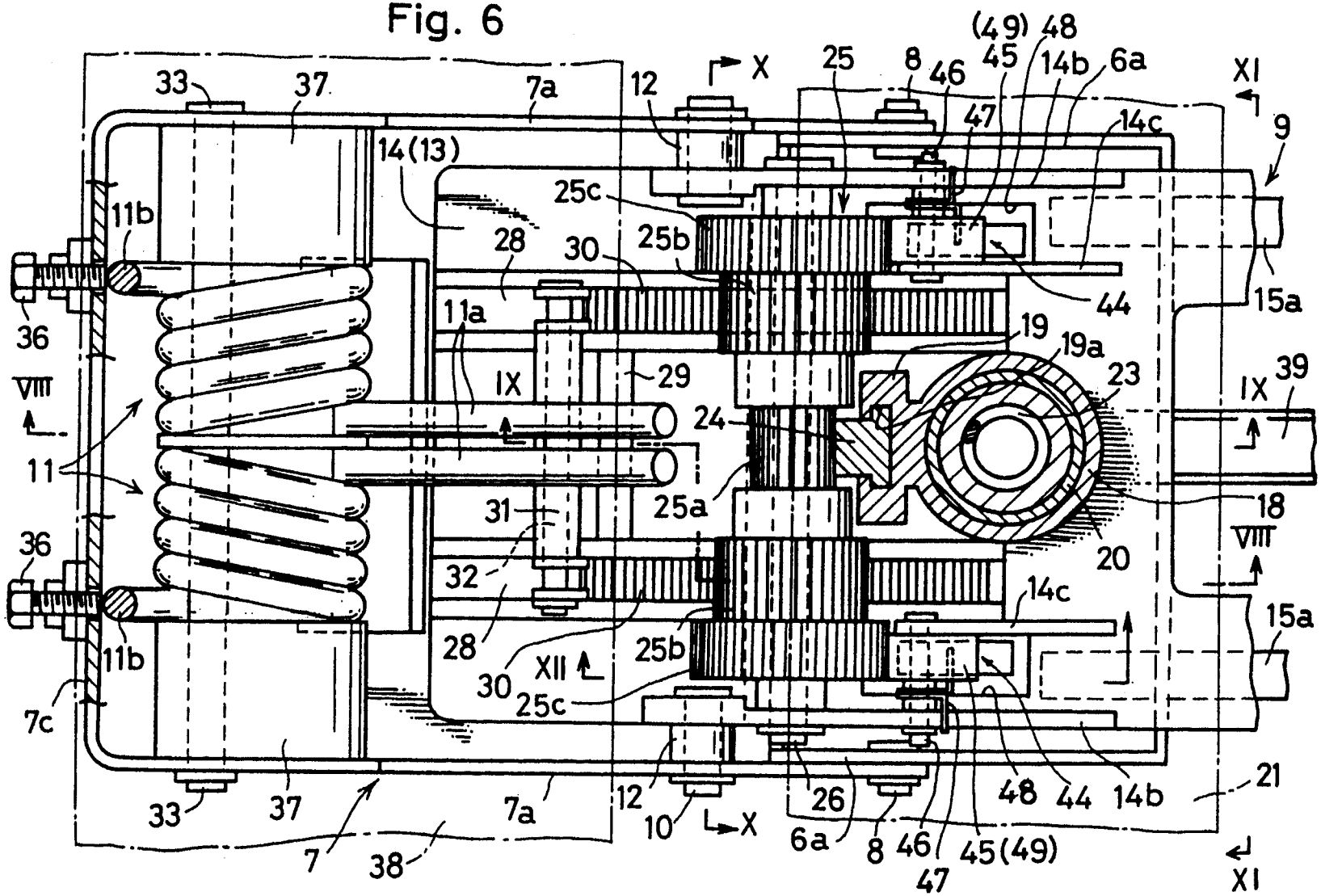
FIG. 6 is a sectional view taken on lines VI—VI in FIG. 1.
Figure 8:
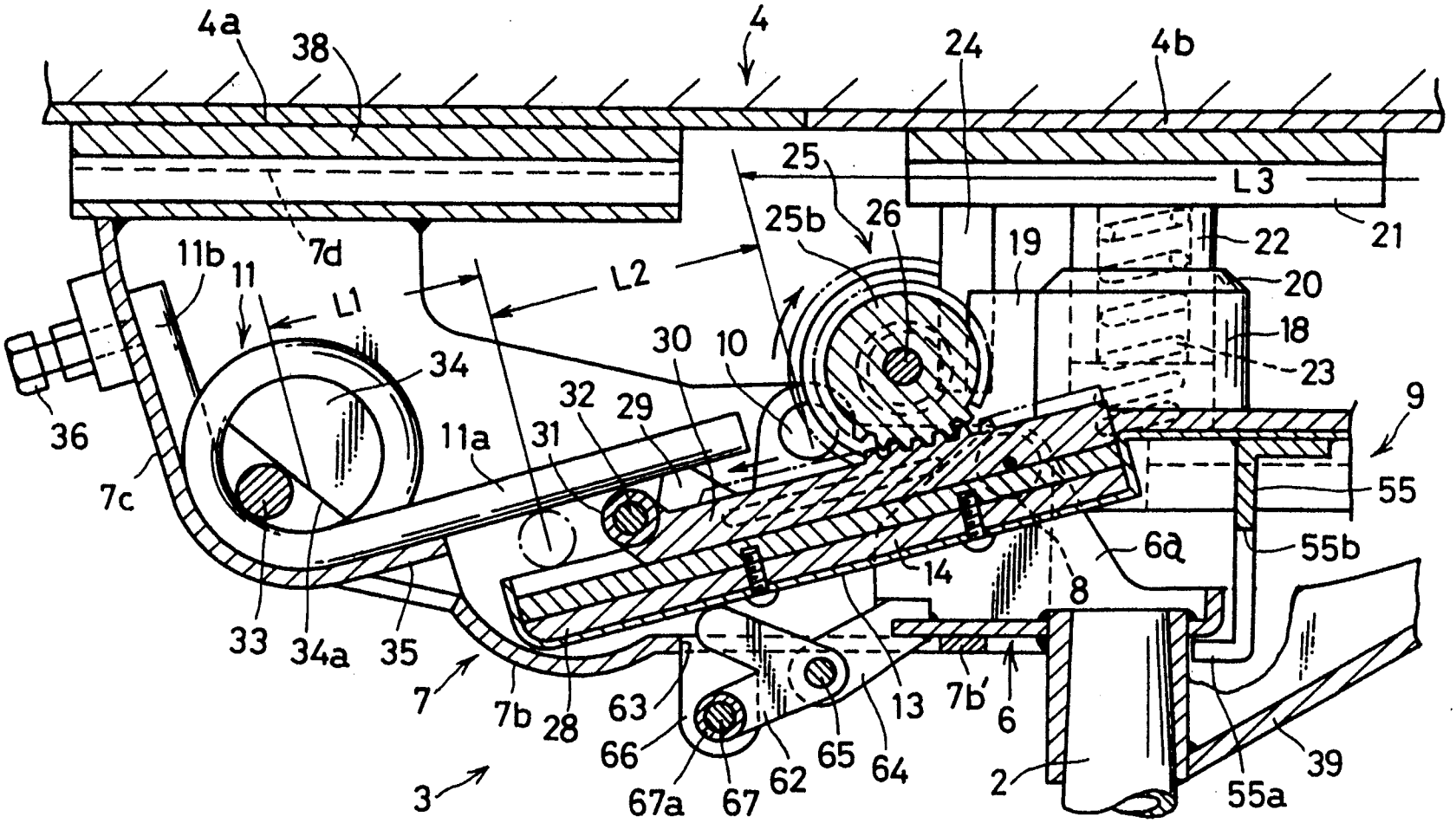
FIG. 8 is a sectional view taken along lines VIII—VIII in FIG. 1.

As shown in FIGS. 6 and 8, each of the tilting control springs 11 is in the form of a torsion coil spring according to the illustrated embodiment. The coil spring 11 has a load receiving leg 11*a* and an anchoring leg 11*b* engaging against the front wall 7*c* of the pivotal frame 7.

Figure 4:
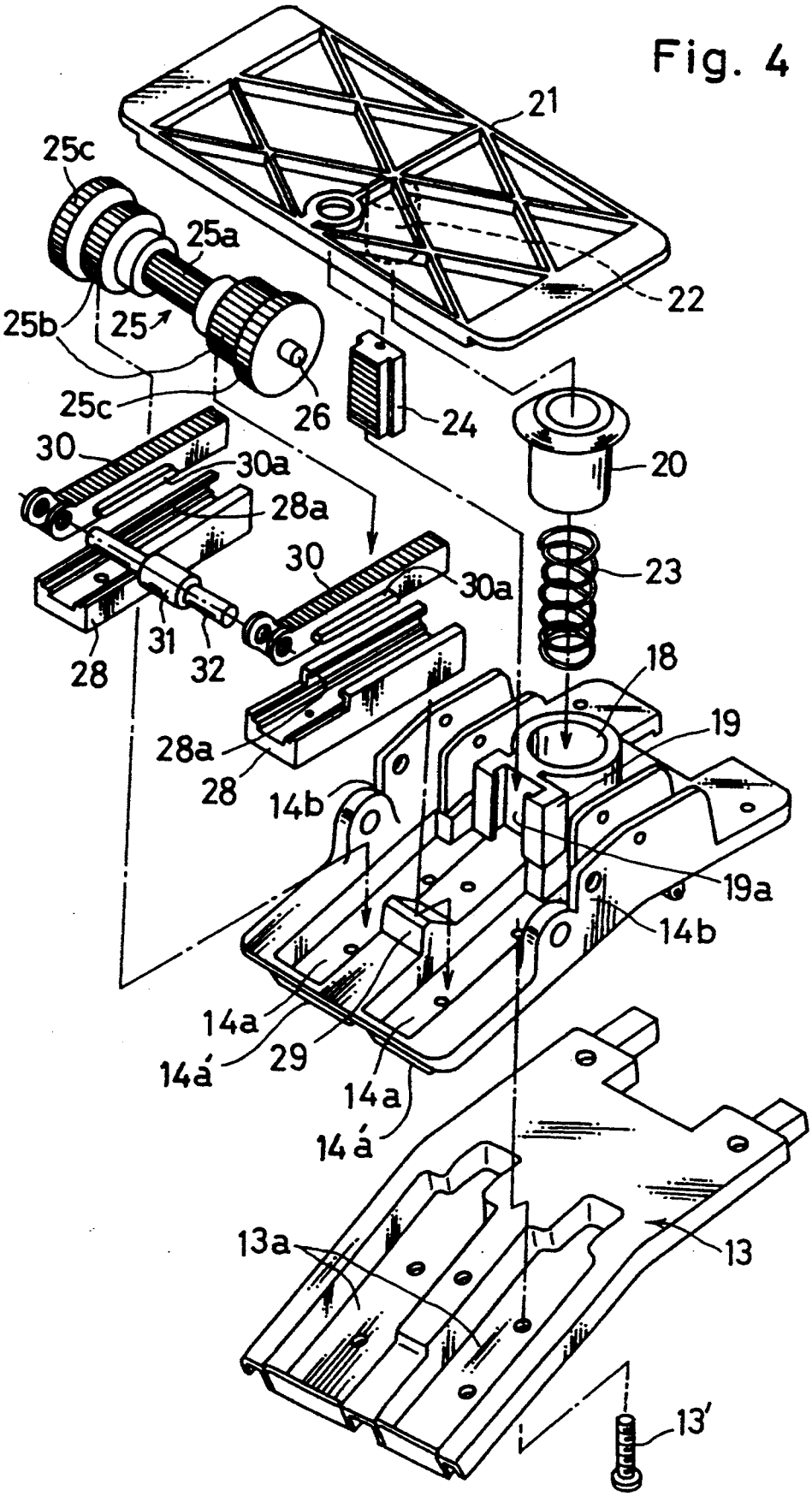

As shown in FIGS. 2–4, the tiltable member 9 includes a base 13 made of a metal plate for example, a mechanism carrier 14 fixed on the base 13 and made of a synthetic resin for example, and a pair of generally L-shaped frame bars 15.

The base member 13 is formed with a parallel pair of upwardly open grooves 13*a* (FIG. 4), whereas the mechanism carrier 14 is formed with a pair of downward projections 14*a*′ fitted in the respective grooves 13*a* of the base. The carrier 14 is fixed to the base 13 by set screws 13′ (only one shown in FIG. 4). On the upper side of the downward projections 14*a*′ of the carrier 14 are formed a pair of elongate recesses 14*a*.

The mechanism carrier 14 has a pair of upwardly directed outer side brackets 14*b* and a pair of upwardly directed inner side brackets 14*c* (FIGS. 3, 4 and 6). The outer side brackets 14*b* are connected respectively to the side walls 7*a* of the pivotal frame 7 by the respective second pivots 10. Thus, the tiltable member 9 is pivotable about the second pivots 10 relative to the pivotal frame 7 which itself is pivotable about the first pivots 8 relative to the fixed frame 6. Each of the second pivots 10 is provided with a spacer 12 between the outer side brackets 14*b* and the side walls 7*a* (FIG. 6).

Figure 1:
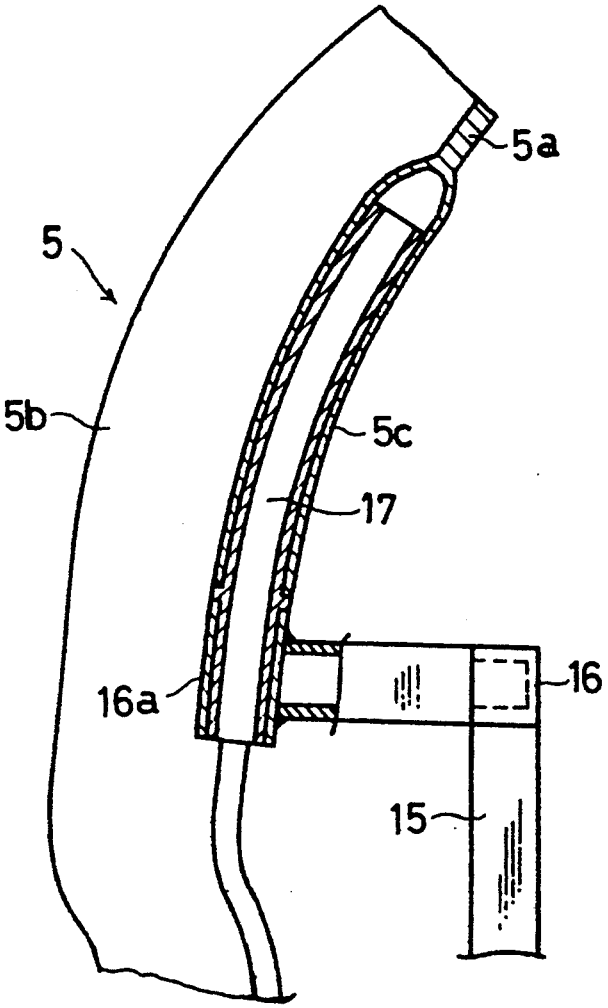
FIG. 1 is a side view, partially in section, showing the seat back of a rocking chair according to a first embodiment of the present invention.

Each of the L-shaped frame bars 15 has a horizontal portion 15*a* fixed to the base 13, and the upper end of the frame bar 15 is fixed to a horizontal connecting bar 16. As shown in FIGS. 1, 3 and 5, both ends of the connecting bar 16 are provided respectively with bushes 16*a* which are open vertically. Each of the end bushes 16*a* receives a flanged cylindrical member 17 which is made of a relatively hard but slightly deformable resin. The end bush 16*a* is inserted, as slightly deformed, into a corresponding cylindrical receptacle 5*c* of the back carrier plate 5a, so that the seat back 5 is tiltable with the tiltable member 9.

As shown in FIGS. 2–4, the mechanism carrier 14 is formed with a cylindrical boss 18 which is open upwardly for receiving a guide bush 20. The mechanism carrier 14 is further provided with a first rack guide 19 having a substantially vertical guide key 19a.

As shown in FIGS. 2–4 and 8, a rear support plate 21 made of synthetic resin for example is attached to the underside of the seat tail carrier plate 4b. The rear support plate 21 is provided with a downwardly directed housing cylinder 22 which is slidably fitted, from above, in the guide bush 20. The housing cylinder 22 accommodates a weight responsive coil spring 23 resting on the mechanism carrier 14. Thus, the seat 4 moves downward against the weight responsive coil spring 23 by an amount which is substantially proportional to the weight of the user.

As shown in FIGS. 2–4, 6 and 8, the rear support plate 21 is also provided with a downwardly directed first rack 24 which forms part of an displacing mechanism. The first rack 24 is slidably fitted in the guide key 19a of the first rack guide 19 to move substantially in the vertical direction.

The displacing mechanism also comprises a pinion assembly 25 which includes a shaft 26 rotatably supported by the outer side brackets 14b of the mechanism carrier 14. The shaft 26 supports a first pinion 25a in mesh with the first rack 24 (see particularly FIGS. 6 and 10), a pair of second pinions 25b diametrically larger than the first pinion 25a, and a pair of ratchet gears 25c.

As shown in FIGS. 4, 6, 8 and 10, a pair of second rack guides 28 are arranged in the respective elongate recesses 14a of the mechanism carrier 14 in corresponding relation to the respective second pinions 25b. Each of the second rack guides 28 has a guide key 28a for slidably receiving a second rack 30 which has a pair of longitudinal side wings 30a. The second rack 30 is held in mesh with a corresponding one of the second pinions 25b. Thus, when the pinion assembly 25 rotates in response to vertical movement of the first rack 24 (i.e., the seat 4), the second rack 30 moves back and forth along the second rack guide 28.

In the illustrated embodiment, the displacing mechanism is mainly constituted by the first rack 24, the pinion assembly 25 and the second racks 30. However, it should be appreciated that the displacing mechanism may be otherwise constituted.

As shown in FIGS. 3, 4 and 6, a horizontal load applying pin 32 extends between and is carried by the respective second racks 30 at a position in front of the second pivots 10. In the illustrated embodiment, the pin 32 is provided with a load applying roller 31 for contacting the load receiving legs 11a of the respective tilting control springs 11. However, the roller 31 may be omitted, and the pin 32 may be made to directly bear against the load receiving legs 11a of the respective tilting control springs 11.

Figure 9:
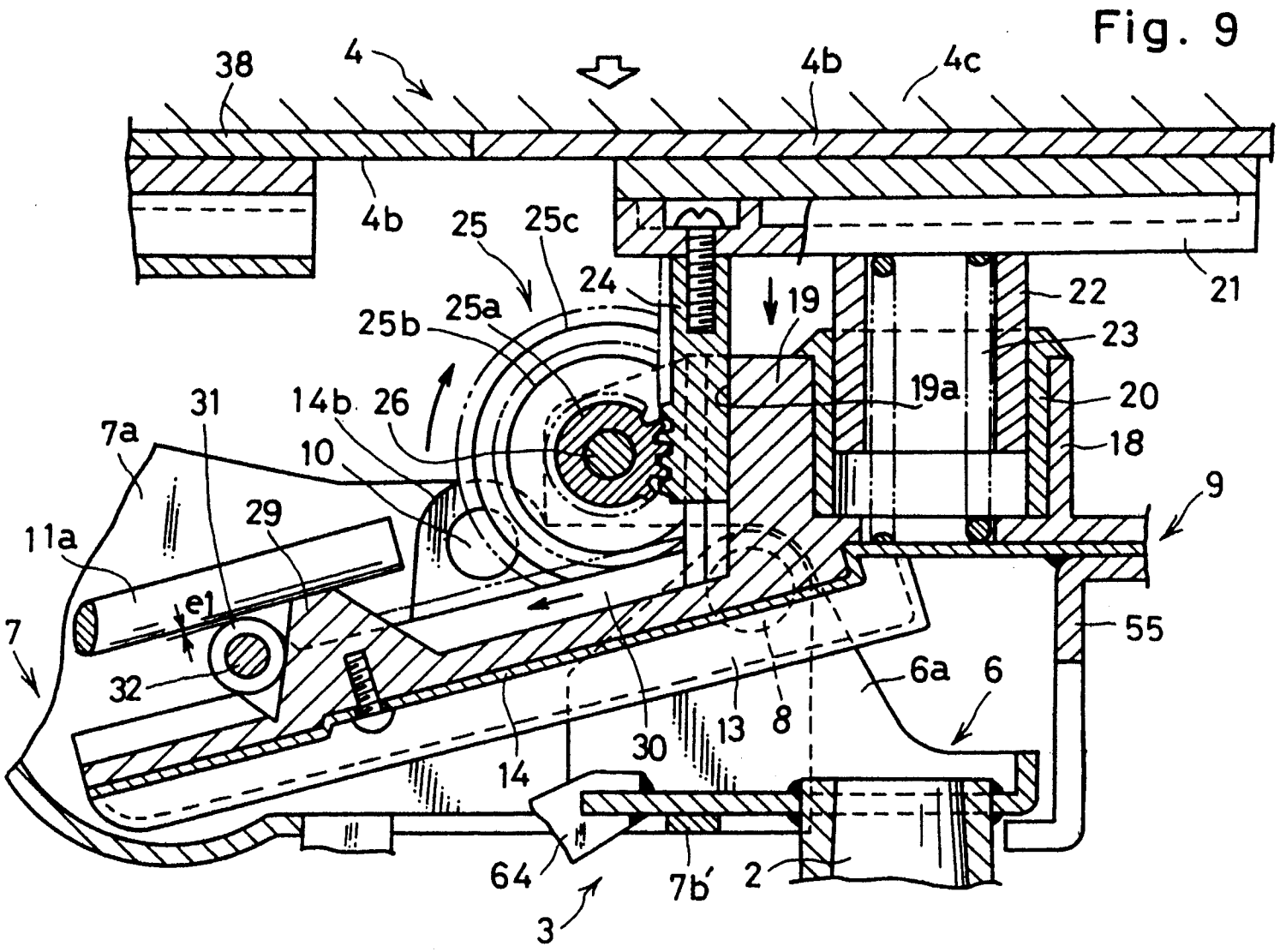
FIG. 9 is a sectional view taken on lines IX—IX in FIG. 6.
Figure 10:
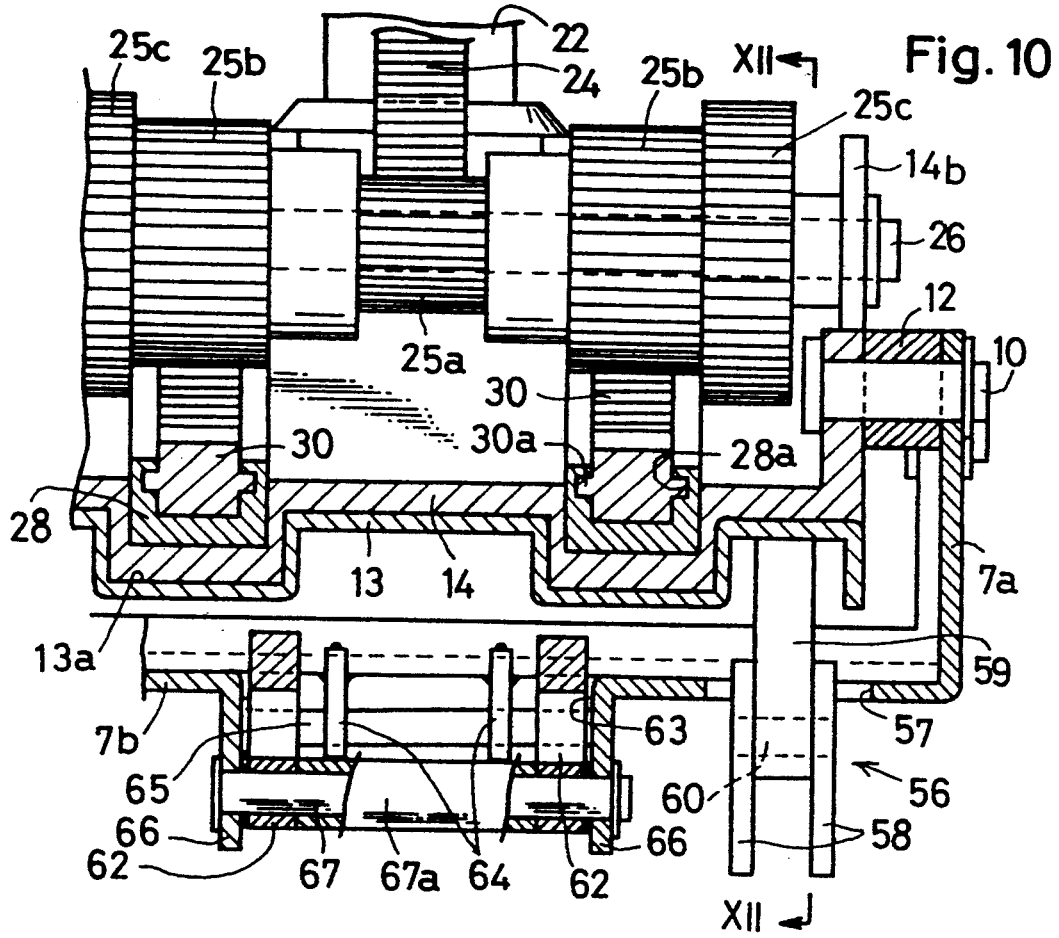
FIG. 10 is a sectional view taken on lines X—X in FIG. 6.
Figure 11:
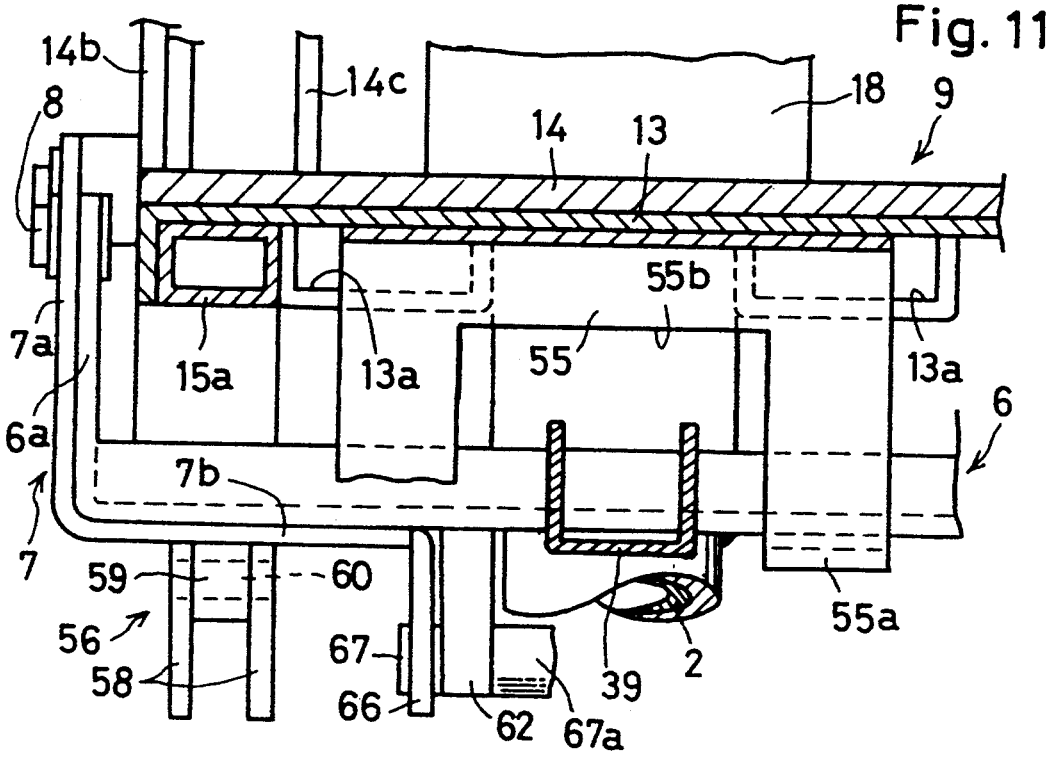
FIG. 11 is a sectional view taken along lines XI—XI in FIG. 6.

As shown in FIGS. 3, 4 and 9, the mechanism carrier 14 is formed with an upwardly projecting stopper 29 which comes into abutment with the load applying roller 31 for preventing the second racks 30 from retreating beyond a certain limit. The stopper 29 is preferably rendered slightly higher than the roller 31, so that a small clearance el (FIG. 9) is formed between the load applying roller 31 and the load receiving legs 11a of the respective tilting control springs 11 before the tiltable member 9 is rearwardly tilted. This clearance el enables the second racks 30 to move smoothly relative to the load receiving legs 11a.

As shown in FIGS. 2, 3, 6 and 8, each of the tilting control coil springs 11 is mounted on an anchor shaft 33 which extends between the respective side walls 7a of the pivotal frame 7. A generally semicylindrical buffer member 34, which may be made of rubber, is inserted in the coil portion of the tilting control spring 11 with its flat face 34a (FIGS. 3 and 8) held in contact with the anchor shaft 33. Thus, the coil portion of the spring 11 contracts diametrically with attendant deformation of the buffer member 34 for elastically controlling rearward tilting of the tiltable member 9.

The bottom wall 7b of the pivotal frame 7 has an upwardly inclined support lip 35 (FIG. 8) for preventing the load receiving legs 11a of the respective tilting control springs 11 from moving downward. Further, the front wall 7c of the pivotal frame 7 is provided with a pair of adjusting screws 36 (FIGS. 6 and 8) which contact the respective anchoring legs 11b of the tilting control springs 11. Thus, it is possible to adjust the initial elastic force of the springs 11 by operating the adjusting screws 36. Indicated at 37 (FIG. 6) is a spacer interposed between each of the springs 11 and the corresponding side wall 7a of the pivotal frame 7 for preventing lateral displacement of the spring 11.

Figure 14:
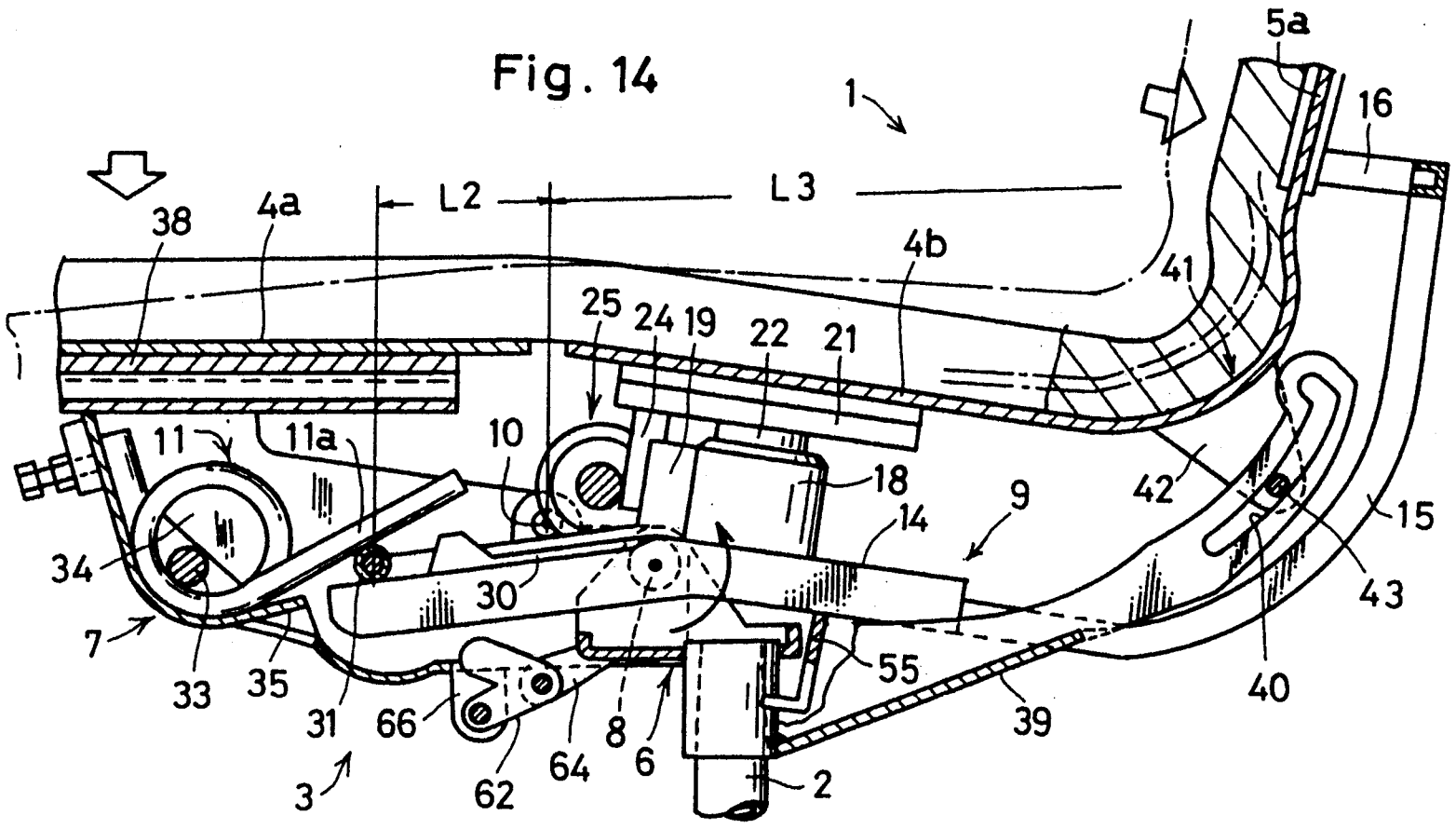
FIG. 14 is a sectional side view showing the same rocking chair in a rearwardly tilted state.

As shown in FIGS. 2, 8 and 14, the side flanges 7d of the pivotal frame 7 are attached to a front support plate 38 which, in turn, is attached to the underside of the seat front carrier plate 4a. Thus, the seat 4 is supported by the pivotal frame 7 on one hand and by the tiltable member 9 (via the rear support plate 21) on the other hand.

As shown in FIGS. 2, 3 and 14, a channel-shaped guide arm 39 extends rearwardly upward from the fixed frame 6. The guide arm 39 has a pair of side walls 39a each formed with a curved guide slot 40.

On the other hand, a curved connecting portion 41 between the seat tail carrier plate 4b and the back carrier plate 5a is provided with a pair of brackets 42 (only one shown in FIGS. 2 and 14) which extend downwardly rearward. Each of the brackets 42 carries a guide pin 43 slidably fitted in the corresponding guide slot 40 of the guide arm 39. Thus, the seat tail carrier 4b together with the seat back 5 is movable rearwardly downward with the guide pin 43 slidably guided by the guide slot 40.

In FIGS. 6, 12, 13 and 16, reference numeral 44 indicates a lock device which forms an important feature of the present invention. This lock mechanism functions to hold the load applying pin 32 (the second racks 30 and the load applying roller 31 as well) at an adjusted position depending on the particular weight of the user, as described below.

The lock device 44 includes the ratchet gears 25c of the pinion assembly 25 already described. The lock device 44 further includes a pair of ratchet members 45 associated with the respective ratchet gears 25c.

Each of the ratchet members 45 is pivotally supported on a pin 46 which is mounted to the corresponding inner side bracket 14c of the mechanism carrier 14. The ratchet member 45 has a pawl 45a for releasable engagement with the corresponding ratchet gear 25c, and an engaging recess 45b which is open downwardly. The ratchet member 45 is always urged by a return spring 47 to bring the ratchet pawl 45a away from the corresponding ratchet gear 25c. The return spring 47 is fitted on the pin 46.

The pivotal movement of the ratchet member 45 is controlled by a corresponding operational member 49 which is pivotally supported on a pin 50 fixed to the base 13. The operational member 49 is elongate and extends through a corresponding perforation 48 of the base 13 and mechanism carrier 14. The operational member 49 has a lower end resting on the bottom wall 6b of the fixed frame 6. The operational member 49 further has an upper end formed with an upwardly convex head 49a engaging in the recess 45b of the ratchet member 45. The convex head 49a is immediately followed by a rearwardly concave guide 49b.

With the arrangement described above, when the user sits on the seat 4, the seat tail carrier plate 4b of the seat 4 moves downward against the weight responsive spring 23 by an amount substantially proportional to the particular weight of the user. The downward movement of the seat tail carrier plate 4b results in corresponding downward movement of the first rack 24 engaging with the first pinion 25a, thereby rotating the pinion assembly 25. Such rotation of the pinion assembly 25 then causes the second racks 30 in mesh with the second pinions 25b to advance with the load applying pin 32 (namely, the load applying roller 31), as indicated by phantom lines in FIG. 8. As a result, the effective length L1 (FIG. 8) of the load receiving leg 11a of each tilting control spring 11, defined as the distance between the coil center of the spring 11 and the load applying pin 32, reduces generally proportionally to the weight of the user.

In this state, if the user leans against the seat back 5, the tiltable member 9 together with the seat back 5 and the seat tail carrier plate 4b is tilted rearwardly downward about the second pivots 10, as shown in FIG. 14. As a result, the load receiving legs 11a of the tilting control springs 11 are elastically raised upward by the load applying roller 31, so that rearward tilting of the seat back 5 and tiltable member 9 is elastically controlled by the tilting control springs 11.

Figure 12:
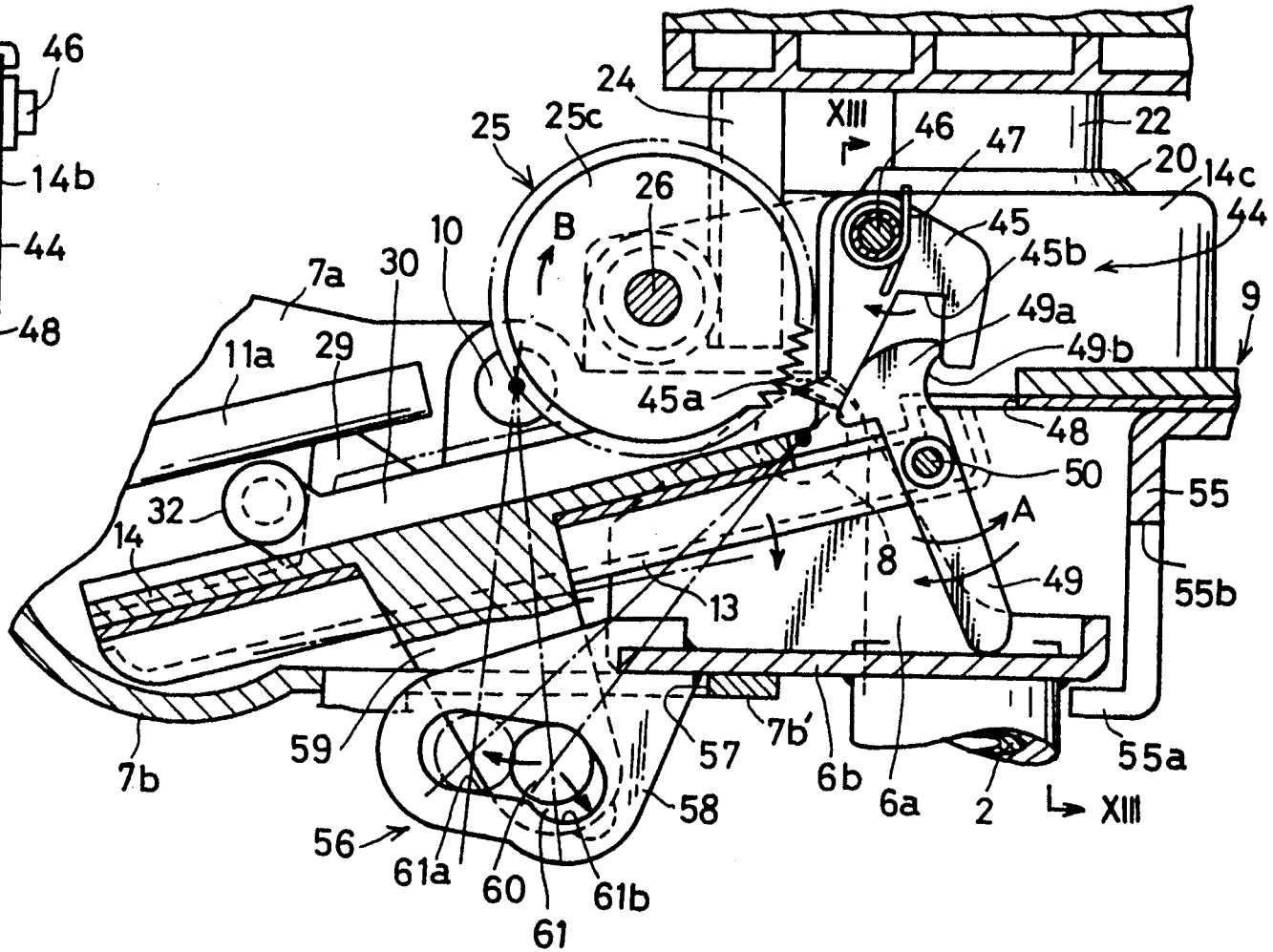
FIG. 12 is a sectional view taken along lines XII—XII in FIGS. 6 and 10.
Figure 13:
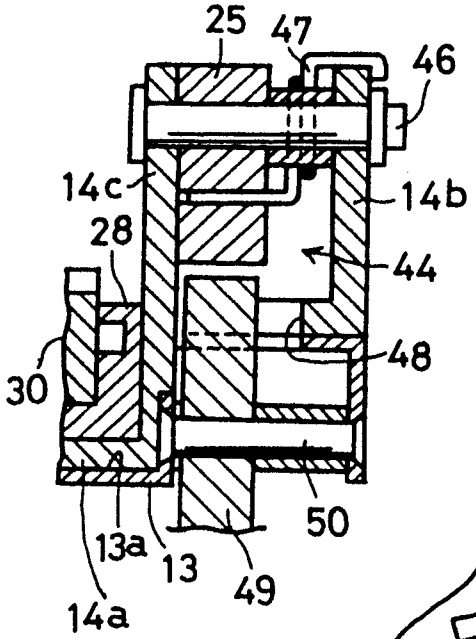
FIG. 13 is a sectional view taken on lines XIII—XIII in FIG. 12.
Figure 16:
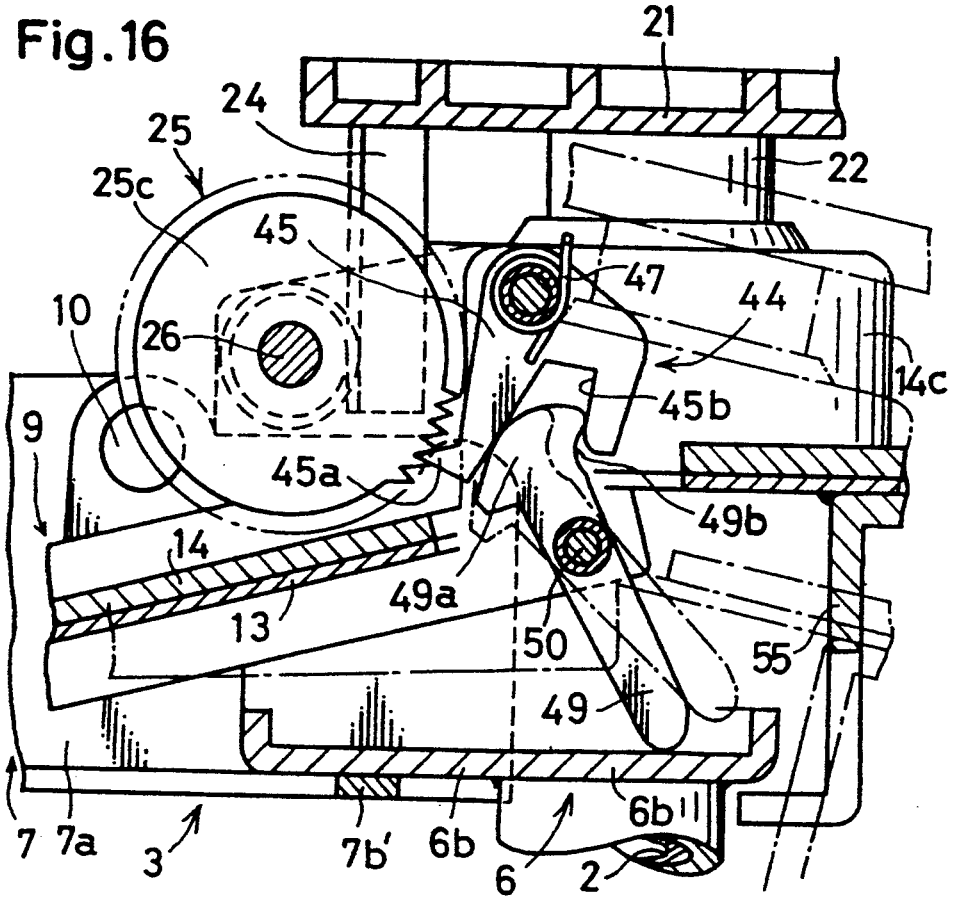
FIG. 16 is a sectional view similar to FIG. 12 to show a locking device in its actuated state.

Further, such rearward tilting of the tiltable member 9 also causes each operational member 49 to pivot in the direction of an arrow A in FIG. 12, thereby pivoting the corresponding ratchet member 45 against the corresponding return spring 49. Thus, the ratchet pawl 45a engages the corresponding ratchet gear 25c to prevent the pinion assembly 25 as a whole from reversely rotating as long as the user leans on the seat back 5, as shown in FIG. 16. As a result, the position of the load applying roller 31, which has been automatically adjusted previously in accordance with the weight of the user, is held fixed relative to the load receiving legs 11a of the respective tilting control springs 11.

It should be appreciated that, due to the provision of the convex head 49a and the concave guide 49b, the operational member 49 is capable of pivoting further in the arrow A direction (FIG. 12) while maintaining engagement between the ratchet pawl 45a and the ratchet gear 25c, as indicated by phantom lines in FIG. 16. Thus, the tiltable member 9 can tilt further rearwardly downward even after the ratchet pawl 49a engages the ratchet gear 25c, so that the provision of the lock device 44 does not hinder the rearward pivotal movement of the tiltable member 9 (namely, the seat back 5).

In the illustrated embodiment, the supportive force provided by each tilting control spring 11 is automatically adjusted to suit the weight of the user because the load applying pin 32 (namely, the load applying roller 31) is displaced relative to the load receiving leg 11a of the spring 11 proportionally to the weight of the user. Such adjustment of the supportive force is realizable for the following reasons.

First, the effective length L1 (FIG. 8) of the tilting control spring 11 reduces progressively as the weight of the user increases, whereas the degree of spring torsion per unit vertical displacement of the load applying pin 32 increases progressively as the effective length L1 reduces. Thus, the tilting control spring 11 provides a larger supportive force for a heavier user than for a lighter user.

Secondly, the pivotal arm length L2 (FIG. 8) of the load applying pin 32, which is defined as the distance between the load applying pin 32 and the second pivots 10, increases progressively as the weight of the user increases, while the vertical displacement of the load applying pin 32 per unit pivotal angle of the tiltable member 9 increases progressively as the pivotal arm length L2 increases. Further, the torsioning degree of the tilting control spring 11 increases progressively as the vertical displacement of the load applying pin 32 increases. Thus, the spring 11 reacts more strongly for a heavier user than for a lighter user.

In the third place, the pivotal arm length L3 (FIGS. 8 and 14) of the seat back 5, which is defined as the distance between the seat back 5 and the second pivots 10, is always constant, whereas the pivotal arm length L2 of the load applying pin 32 increases progressively as the weight of the user increases. Further, according to the force balance rule of leverage, when the pivotal arm length L2 of the load applying pin 32 increases, the tilting control spring 11 need only to apply a smaller reaction force to balance with a given weight or force applied to the seat back 5. Thus, the spring 11 can be considered to become stronger for a heavier user than for a lighter user although the spring constant of the spring 11 itself does not change.

For all of the above reasons, the tilting control spring 11 can provide a uniformly comfortable tilting feel to any user by automatic displacement of the load applying pin 32 which is dependent on the particular user's weight.

Further, as already described, the second pinions 25b in mesh with the second racks 30 are diametrically larger than the first pinion 25a in mesh with the first rack 24, but both kinds of pinions 25a, 25b are mounted on the common shaft 26 for simultaneous rotation. Thus, the advancing stroke of the second racks 30 with the load applying pin 32 can be rendered larger than the downward stroke of the first rack 24. As a result, it is possible to increase the sensitivity in automatically adjusting the supportive force of the tilting control springs 11 against tilting of the tiltable member 9 (namely, the seat back 5).

More importantly, the lock device 44 functions to hold the load applying pin 32 at an initially adjusted position immediately when the user leans against the seat back 5. Thus, the supportive force or ability provided by the tilting control springs 11 can be fixed to suit the particular user's weight as long as the user leans on the seat back 5.

On the other hand, when the user assumes a non-reclining posture again, the pawls 45a of the respective ratchet members 45 pivotally return to their original state under the action of the return springs 47. Thus, the respective ratchet gears 25c are again free to rotate.

As shown in FIGS. 7–9 and 12, the base 13 of the pivotal member 9 is provided with a downwardly extending stopper segment 55 which is L-shaped as viewed laterally and has a pair of engaging lips 55*a* spaced by a cutout 55*b*. The engaging lips 55*a* are made to engage the underside of the fixed frame 6 from below for preventing the tiltable member 9 from pivoting forwardly downward beyond a certain limit. The cutout 55*b* of the stopper segment 55 serves to allow rearwardly downward pivotal movement of the tiltable member 9 in relation to the chair leg post 2.

In the illustrated embodiment, the rocking chair 1 (FIG. 1) further incorporates a rocking guide mechanism 56, as shown FIGS. 7 and 10–12. This rocking guide mechanism 56 connects between the fixed frame 6 and the tiltable member 9.

Figure 7:
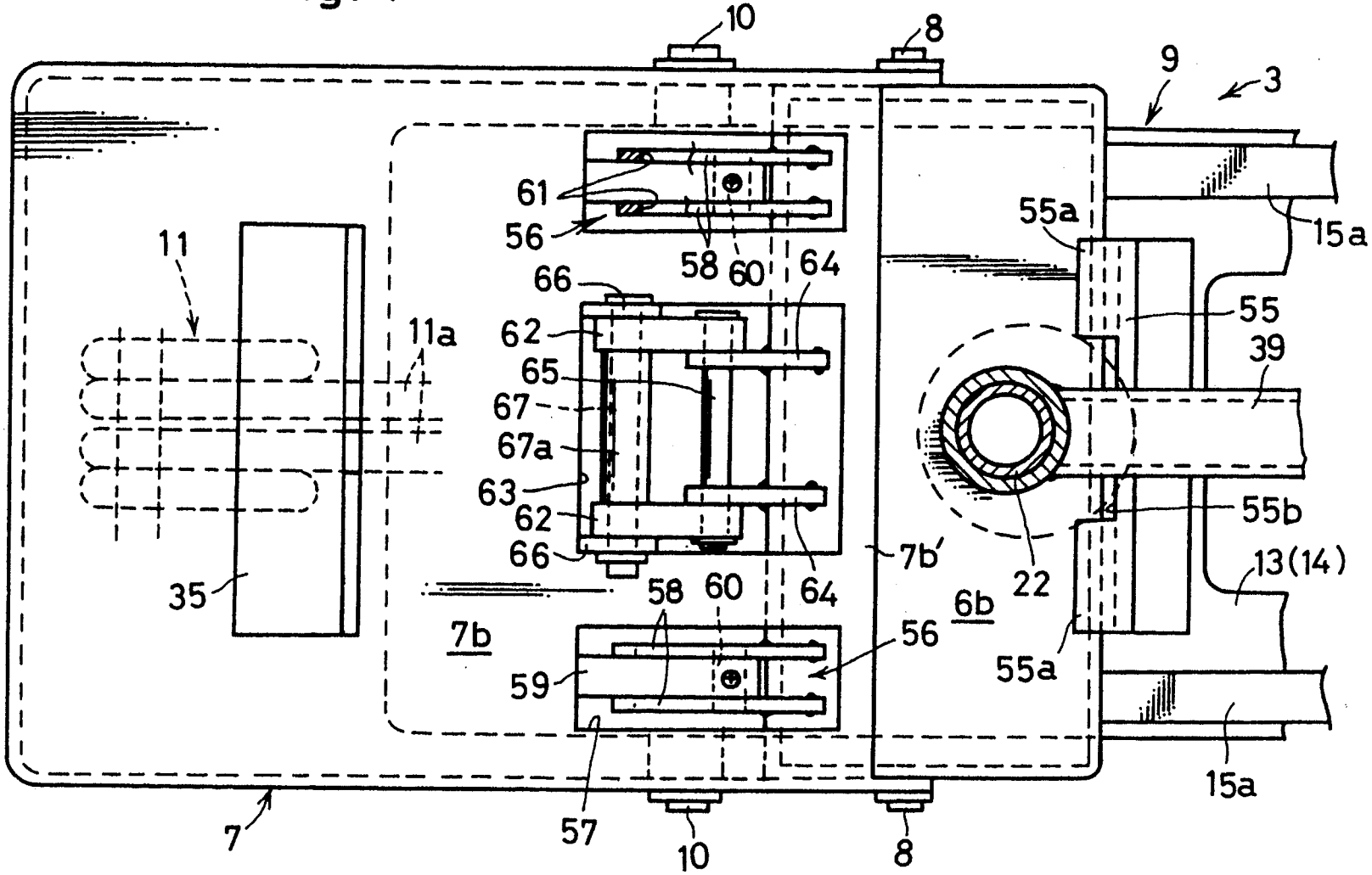
FIG. 7 is a sectional view taken along lines VII—VII in FIG. 1.

The rocking guide mechanism 56 comprises two pairs of guide brackets 58 fixed to the bottom wall 6*b* of the fixed frame 6 to extend downwardly through corresponding side openings 57 formed in the bottom wall 7*b* of the pivotal frame 7 (see particularly FIG. 7). Each of the guide brackets 58 has a guide slot 61 which includes a substantially horizontal portion 61*a* and an inclined portion 61*b*. The horizontal slot portion 61*a* generally follows an arc about the second pivots 10, whereas the inclined slot portion 61*b* generally follows an arc about the first pivots 8.

The rocking guide mechanism 56 further comprises another pair of brackets 59 extending downwardly from the mechanism carrier 14 also through the corresponding openings 57 of the pivotal frame 7. Each of the brackets 59 carries a guide pin 60 slidably fitting in the respective guide slots 61 of the corresponding pair of guide brackets 58.

As already described, the pivotal frame 7 is pivotable about the first pivots 8 which are mounted on the fixed frame 6, whereas the tiltable member 9 is pivotable about the second pivots 10. Further, since the second pivots 10 are mounted on the pivotal frame 7 which itself is pivotable about the first pivots 8, the tiltable member 9 is also pivotable about the first pivots 8. Thus, if no countermeasure is taken, the tiltable member 9, which has been tilted rearwardly downward by the reclining posture of the user, may pivot upward about the first pivots 8 (instead of the second pivots 10) together with the pivotal frame 7 which itself pivots forwardly downward about the first pivots 8. In this case, the tilting control springs 11 do not act against the tiltable member 9 because the relative position between the pivotal frame 7 and the tiltable member 9 does not change at the time of commonly pivoting about the first pivots 8, consequently failing to elastically control rocking movement of the seat back 5.

However, with the rocking guide mechanism 56, when the tiltable member 9 pivots rearwardly downward about the second pivots 10, each guide pin 60 carried by the corresponding bracket 59 (namely, the tiltable member 9) shifts deeper into the horizontal portion 61*a* of the corresponding guide slot 61, as indicated by phantom lines in FIG. 12. Since the horizontal slot portion 61*a* generally follows an arc only about the second pivots 10, the tiltable member 9 thus rearwardly pivoted can pivot back only about the second pivots 10. In other words, the tiltable member 9, which has been previously pivoted rearwardly downward, cannot pivot back commonly with the pivotal frame 7 about the first pivots 8. Therefore, the rocking movement of the tiltable member 9 (namely, the seat back 5) occurs always under the influences of the tilting control springs 11.

On the other hand, once the tiltable member 9 pivotally returns to the initial normal position (FIG. 1), each guide pin 60 assumes a solid line position of FIG. 12 for entry into the inclined portion 61*b* of the corresponding guide slot 61. In this state, the tiltable member 9 can now pivot forwardly upward with the pivotal frame 7 (which itself pivots forwardly downward) commonly about the first pivots 8.

Further, in the illustrated embodiment, the support device 3 is provided with a pair of V-shaped links 62, as shown in FIGS. 2, 7, 8, 10, 11 and 14. Specifically, the bottom wall 7*b* of the pivotal frame 7 is formed with a central perforation 63, and the pair of V-shaped links 62 are arranged at the central perforation 63 with their V-apexes directed rearward. The V-apexes of the respective links 62 are pivotally connected to a pair of brackets 64 by means of a common pin 65, and the brackets 64 are attached to the fixed frame 6. The respective links 62 have their downwardly directed legs pivotally connected, via another common pin 67, to another pair of brackets 66 fixed to the bottom wall 7*b* of the pivotal frame 7. The pin 67 has a central collar 67*a* serving as a spacer between the links 62. Further, the respective links have their upwardly directed legs bearing, from below, against the base 13 of the tiltable member 9 at a position ahead of the second pivots 10.

Obviously, the links 62 do not hinder rearward pivotal movement of the tiltable member 9 because the upwardly directed legs of the links 62 bear the tiltable member 9 only from below. Such rearward pivotal movement of the tiltable member 9 causes torsioning of the tilting control springs 11 because the pivotal frame 7 is prevented from pivoting upward beyond the horizontal position (FIGS. 2 and 8) by the engagement between the fixed frame 6 and the pivotal frame 7.

Figure 15:
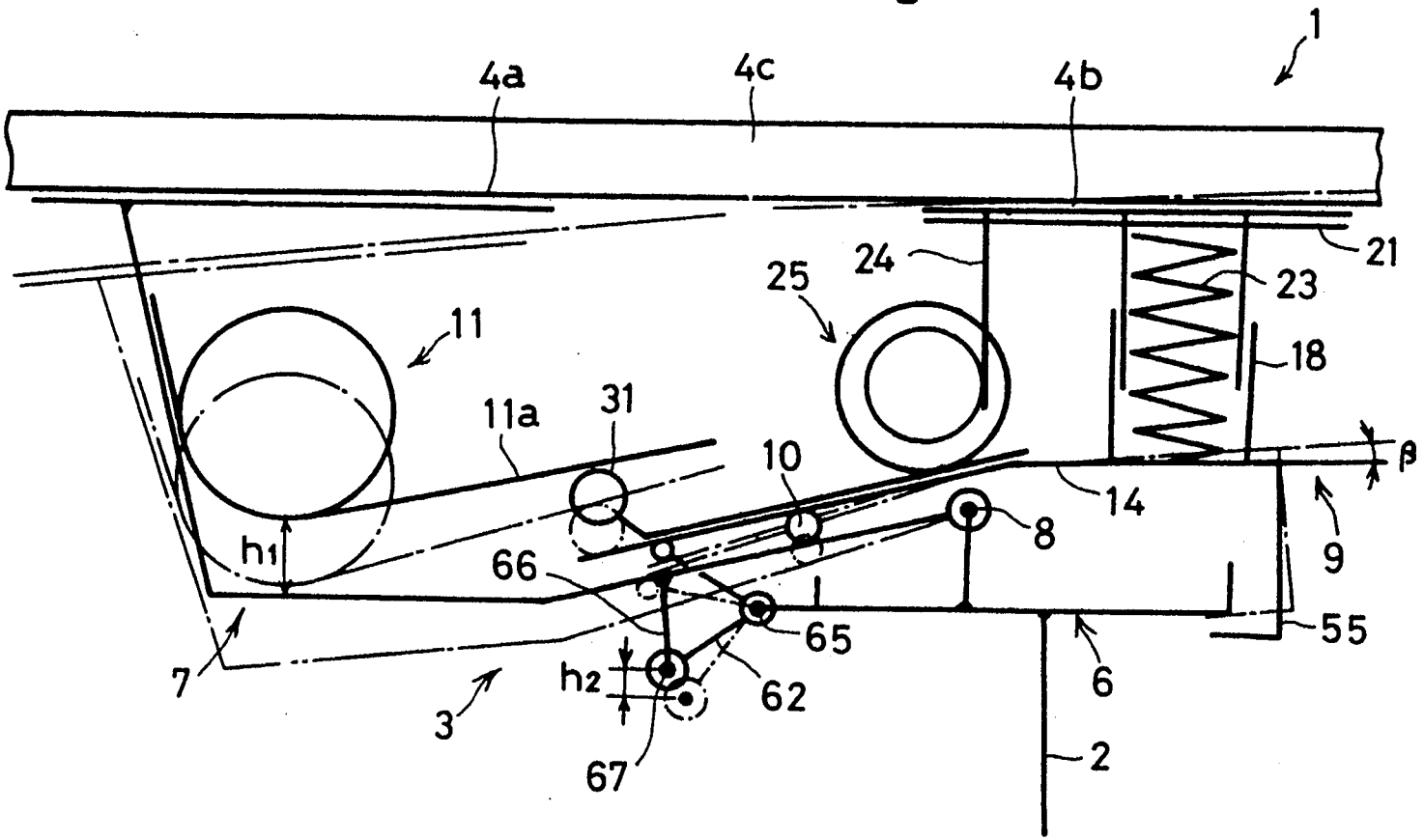
FIG. 15 is a schematic side view illustrating the operation of the same rocking chair at the time of forward tilting.

On the other hand, when the pivotal frame 7 pivots forwardly downward about the first pivots 8, the tiltable frame 9 also pivots forwardly about the first pivots 8 within a limited angular range B allowed by the stopper segment 55 engageable with the fixed frame 6, as schematically shown in FIG. 15. In this case, the tilting control springs 11 moves downward with the pivotal frame 7 by an amount h1, whereas the links 62 pivotally move downward with the tiltable member 9 by a smaller amount h2. Thus, the tilting control springs 11 are torsioned by a degree determined by the difference between h1 and h2 because the load applying roller 31 also moves with the links 62 and the tiltable member 9.

Due to the provision of the links 62, the tilting control springs 11 can also function to elastically control forward tilting of the pivotal frame 7 (namely, the seat front carrier plate 4*a*) in addition to elastically controlling rearward tilting of the tiltable member 9. If the links 62 are not provided, the pivotal frame 7 pivots forwardly downward about the first pivots 8 together with the tiltable member 9 without torsional deformation of the tilting control springs 11. Thus, the links 62 are significant in ensuring that the pivotal frame 7 is forwardly pivoted to a greater degree than the tiltable member 9, thereby torsioning the tilting control springs 11.

Further, due to the provision of the links 62, the supportive force of the tilting control springs 11 is stronger when the tiltable member 9 is pivoted rearwardly downward than when the pivotal frame 7 is pivoted forwardly downward. This point is very significant since rearward pivoting is more forceful due to leaning of the user's back against the seat back 5 whose arm length L3 (FIG. 14) is relatively large.

Specifically, when the tiltable member 9 is pivoted rearwardly downward, the tilting control springs 11 are torsioned as much as the tiltable member 9 is pivoted because the pivotal frame 7 is prevented from pivoting upward by the engagement between the pivotal frame 7 and the fixed frame 6. When the pivotal frame 7 is pivoted forwardly downward, on the other hand, the tilting control springs 11 are torsioned only by an amount corresponding to the difference between h1 and h2 (FIG. 15) because the tiltable member 9 also pivots forwardly (by a smaller amount), as already described. Thus, the same tilting control springs 11 can provide two different supportive forces suitable for elastically controlling the tilting movement of the seat 4 in both directions.

The stopper segment 55 prevents the tiltable member 9 from pivoting forwardly beyond the angular range B. After this situation is reached, the pivotal frame 7 alone can pivot forwardly downward, so that the tilting control springs 11 continues to be further torsioned.

EMBODIMENT 2

Figure 17:
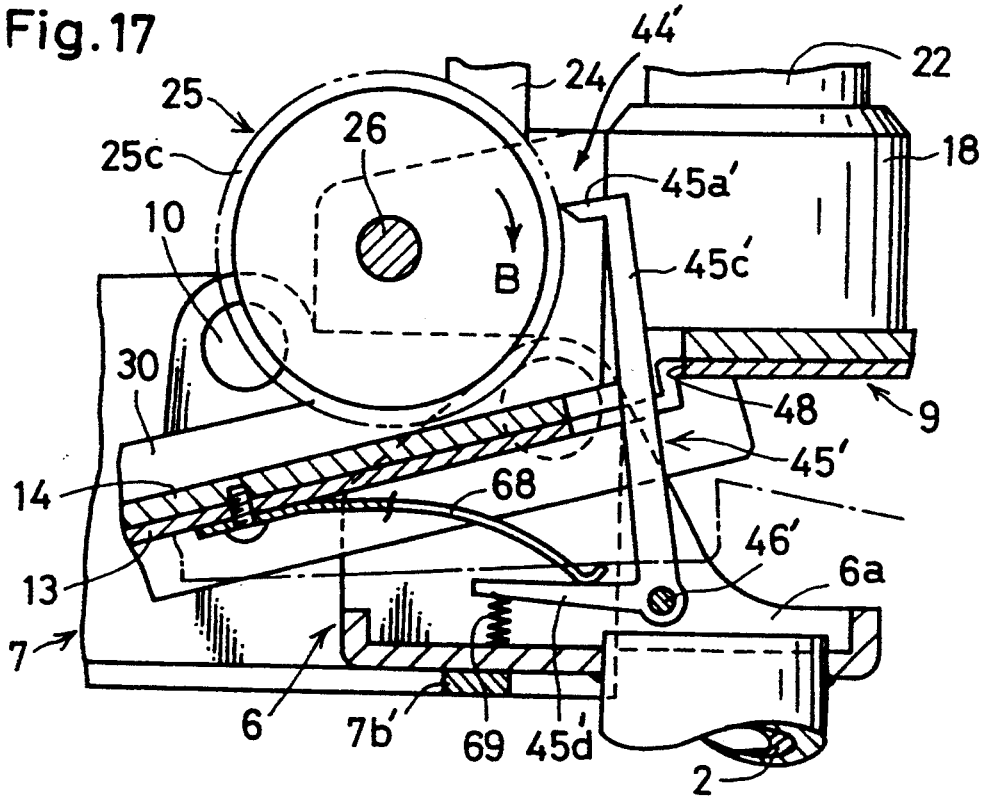
FIG. 17 is a sectional view similar to FIG. 16 but showing a lock device according to a second embodiment of the present invention.

FIG. 17 shows a principal portion of a chair according to a second embodiment of the present invention. The chair of this embodiment differs from that of the first embodiment only in that it incorporates a modified lock device 44'.

Specifically, the modified lock device 44' includes a pair of ratchet members 45' (only one shown) cooperative with a corresponding pair of ratchet gears 25c. Each of the ratchet members 45' is pivotally supported on a pin 46' mounted on the 5 fixed frame 6.

Each ratchet member 45' has a first leg 45c' extending upwardly through a corresponding perforation 48 of the base 13 and mechanism carrier 14, and a second leg 45d' extending generally horizontally. The first leg 45c' is formed, at its upper end, with a pawl 45a' for releasable engagement with the corresponding ratchet gear 25c. The second leg 45d' is always biased upward by a compression coil spring 69 arranged under the second leg 45d'. Further, the second leg 45d' bears, from below, against a leaf spring 68 attached to the base 13. The leaf spring 68 is stronger than the compression coil spring 69.

With the modified lock device 44', when the tiltable member 9 pivots rearwardly, the leaf spring 68 depresses the second leg 45d' of the ratchet member 45', so that the pawl 45a' comes into locking engagement with the corresponding ratchet gear 25c. Conversely, when the tiltable member 9 pivotally returns to its original position, the compression coil spring 69 causes the ratchet member 45' to pivot reversely, thereby liberating the ratchet gear 25c.

EMBODIMENT 3

FIGS. 18 and 19 show a principal portion of a rocking chair according to a third embodiment of the present invention. The rocking chair of this embodiment also differs from that of the first embodiment only in that it incorporates another modified lock device 44'' which is designed to act immediately when the user sits.

Again, the modified lock device 44'' of the third embodiment includes a pair of ratchet members 45'' (only one shown) cooperative with a corresponding pair of ratchet gears 25c. Each of the ratchet members 45'' is arranged between the corresponding outer and inner side brackets 14b, 14c of the mechanism carrier 14, and connected to a lever 73 by means of a guide pin 70.

Each ratchet member 45'' is elongate and has a pawl 45a'' for releasable engagement with the corresponding ratchet gear 25c. The ratchet member 45'' is provided, on both sides thereof, with a pair of guide projections 45e'' extending transversely of the elongate ratchet member 45''. The guide projections 45e'' are held in sliding contact with respective guide rails 72 formed on the outer and inner side brackets 14b, 14c. Further, the outer and inner side brackets 14b, 14c are formed with guide slots 71 extending in parallel to the guide rails 72, and the guide pin 70 is slidably received in the guide slots 71. Thus, the ratchet member 45'' is slidably movable toward and away from the corresponding ratchet gear 25c.

The lever 73 is pivotally supported on a pin 74 extending between the outer and inner side brackets 14b, 14c of the mechanism carrier 14. The lever 73 has a front end which is bifurcated to provide a pair of legs 73a located on both sides of the corresponding ratchet member 45''. Each of the legs 73a is formed with a play slot 75 which extends transversely of the guide slots 71 and is penetrated by the guide pin 70. The play slot 75 allows pivotal movement of the lever 73.

Behind the pin 74, the lever 73 is biased downward by a compression coil spring 76. Ahead of the pin 74, the lever 73 is urged downward by a tension coil spring 77. Thus, these two kinds of springs 76, 77 act in the counteracting directions, and the lever 73 is normally held in the position shown in FIG. 18. Indicated by reference numeral 78 is a leaf spring 78 for supporting the ratchet member 45'' in its lower limit position.

According to the third embodiment, the orientation of the ratchet member 45'' and the shape of the ratchet pawl 45a'' are selected so that the ratchet gear 25c is allowed to rotate in the direction of an arrow B (which is the rotational direction for advancing the second racks) even if the ratchet pawl 45a'' engages with the ratchet gear 25c. On the other hand, the ratchet gear 25c is prevented from rotating reversely when the ratchet pawl 45a'' engages with the ratchet gear 25c.

In operation, when the rear support plate 21 is depressed by a sitting action of the user, the lever 73 is pressed by the compression spring 76 and pivots in the direction of an arrow C. Such pivotal movement of the lever 73 causes the ratchet member 45'' to translationally move toward the corresponding ratchet gear 25c, so that the ratchet pawl 45a'' comes into engagement with the ratchet gear 25c. However, as described above, the ratchet gear 25c continues to rotate in the arrow B direction while the ratchet member 45'' moves back and forth within a slight range. On the other hand, the ratchet gear 25c is prevented from rotating reversely, thereby holding the second racks (not shown) at an adjusted position.

When the rear support plate 21 moves upward upon removal of the use's weight, the lever 73 is pivotally returned to its original position under the action of the tension spring 77. As a result, the ratchet pawl 45a'' disengages from the ratchet gear 25c which is therefore freed to rotate reversely.

EMBODIMENT 4

Figure 20:
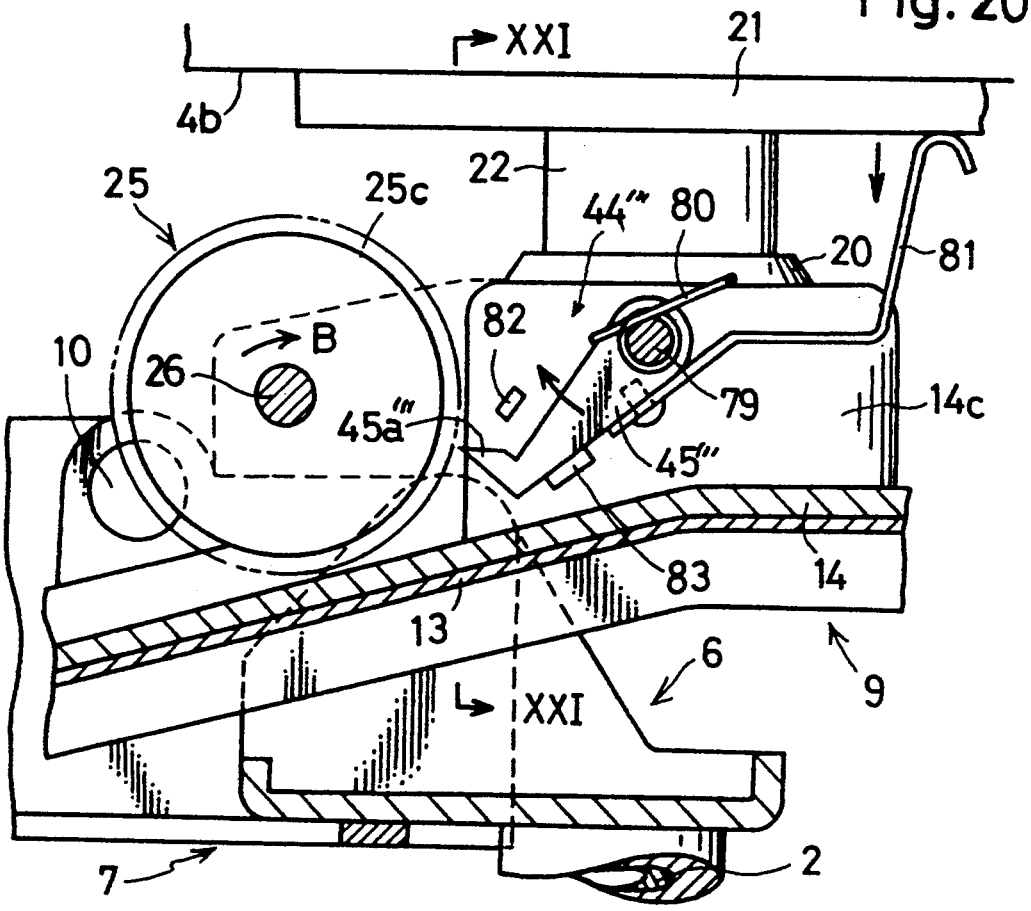
FIG. 20 is a sectional view also similar to FIG. 16 but showing a lock device according to a fourth embodiment of the present invention.
Figure 21:
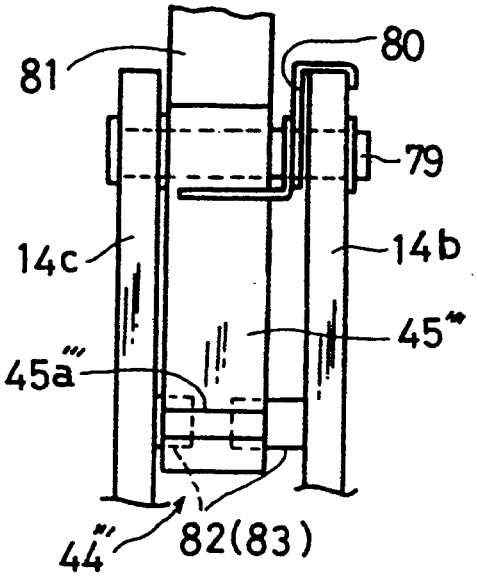
FIG. 21 is a sectional view taken along lines XXI—XXI in FIG. 20.

FIGS. 20 and 21 show a principal portion of a rocking chair according to a fourth embodiment of the present invention. The rocking chair of this embodiment also differs from that of the first embodiment only in that it incorporates a further modified lock device 44'' which is designed to act immediately when the user sits.

Again, the modified lock device 44''' of the fourth embodiment includes a pair of ratchet members 45''' (only one shown) cooperative with a corresponding pair of ratchet Gears 25c. Each of the ratchet members 45''' is pivotally supported on a pin 79 extending between the corresponding outer and inner side brackets 14b, 14c of the mechanism carrier 14.

Each ratchet member 45''' is elongate and has a pawl 45a''' for releasable engagement with the corresponding ratchet Gear 25c. Similarly to the third embodiment, the orientation of the ratchet member 45''' and the shape of the ratchet pawl 45a''' are selected so that the ratchet gear 25c is allowed to rotate in the direction of an arrow B (which is the rotational direction for advancing the second racks) even if the ratchet pawl 45a''' engages with the ratchet gear 25c. On the other hand, the ratchet gear 25c is prevented from rotating reversely when the ratchet pawl 45a''' engages with the ratchet gear 25c.

The ratchet member 45''' is always urged in the direction away from the ratchet gear 25c by a return coil spring 80 fitted on the pin 79. Further, the ratchet member 45''' carries a leaf spring 81 bearing against the rear support plate 21 from below. The pivotal movement of the ratchet member 45''' is limited in both directions by stoppers 82, 83.

In operation, when the rear support plate 21 is depressed by a sitting action of the user, the leaf spring 81 is pressed downward, thereby causing the ratchet member 45''' to pivot toward the corresponding ratchet gear 25c. As a result, the ratchet pawl 45a''' comes into engagement with the ratchet gear 25c, but the ratchet gear 25c continues to rotate in the arrow B direction while the ratchet member 45'' moves back and forth within a slight range. On the other hand, the ratchet gear 25c is prevented from rotating reversely, thereby holding the second racks (not shown) at an adjusted position.

When the rear support plate 21 moves upward upon removal of the use's weight, the ratchet member 45''' is pivotally returned to its original position under the action of the return spring 80. As a result, the ratchet pawl 45a''' disengages from the ratchet gear 25c which is therefore freed to rotate reversely.

In any of the four embodiments described above, use is made of the lock device 44, 44', 44'' 44''' wherein the ratchet gears 25c are incorporated in the pinion assembly 25. However, the lock mechanism may comprise a ratchet rack movable with each of the second racks 30, and a ratchet pawl member carried by the mechanism carrier 14 for releasable engagement with the ratchet rack. Alternatively, the lock mechanism may comprise a ratchet rack fixed on the mechanism carrier 14, and a ratchet pawl member carried by the pinion assembly 25 for releasable engagement with the fixed ratchet rack.

EMBODIMENT 5

FIGS. 22 through 33 show a chair according to a fifth embodiment of the present invention.

Figure 22:
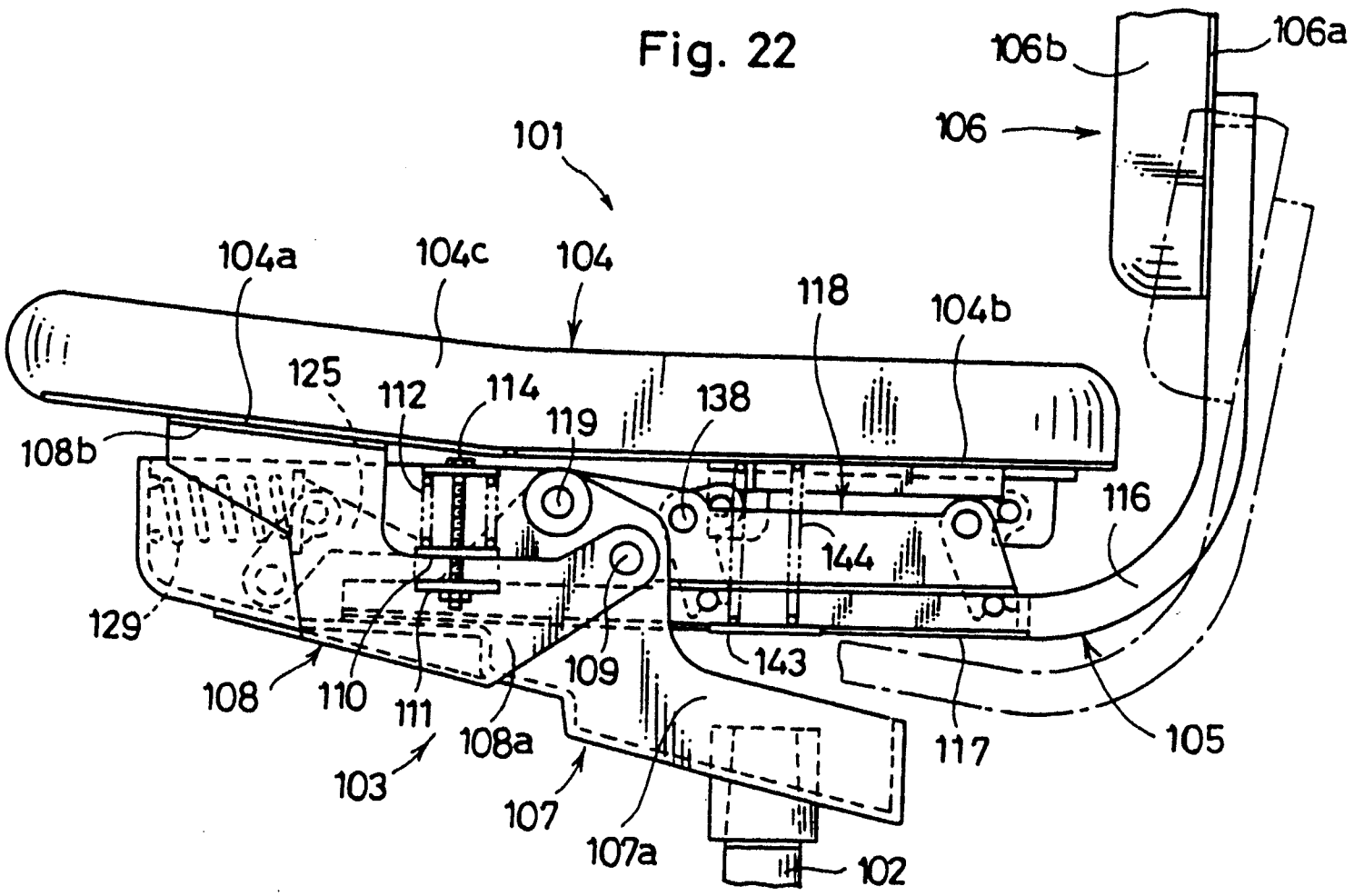
FIG. 22 is a side view showing a chair according to a fifth embodiment of the present invention.
Figure 23:
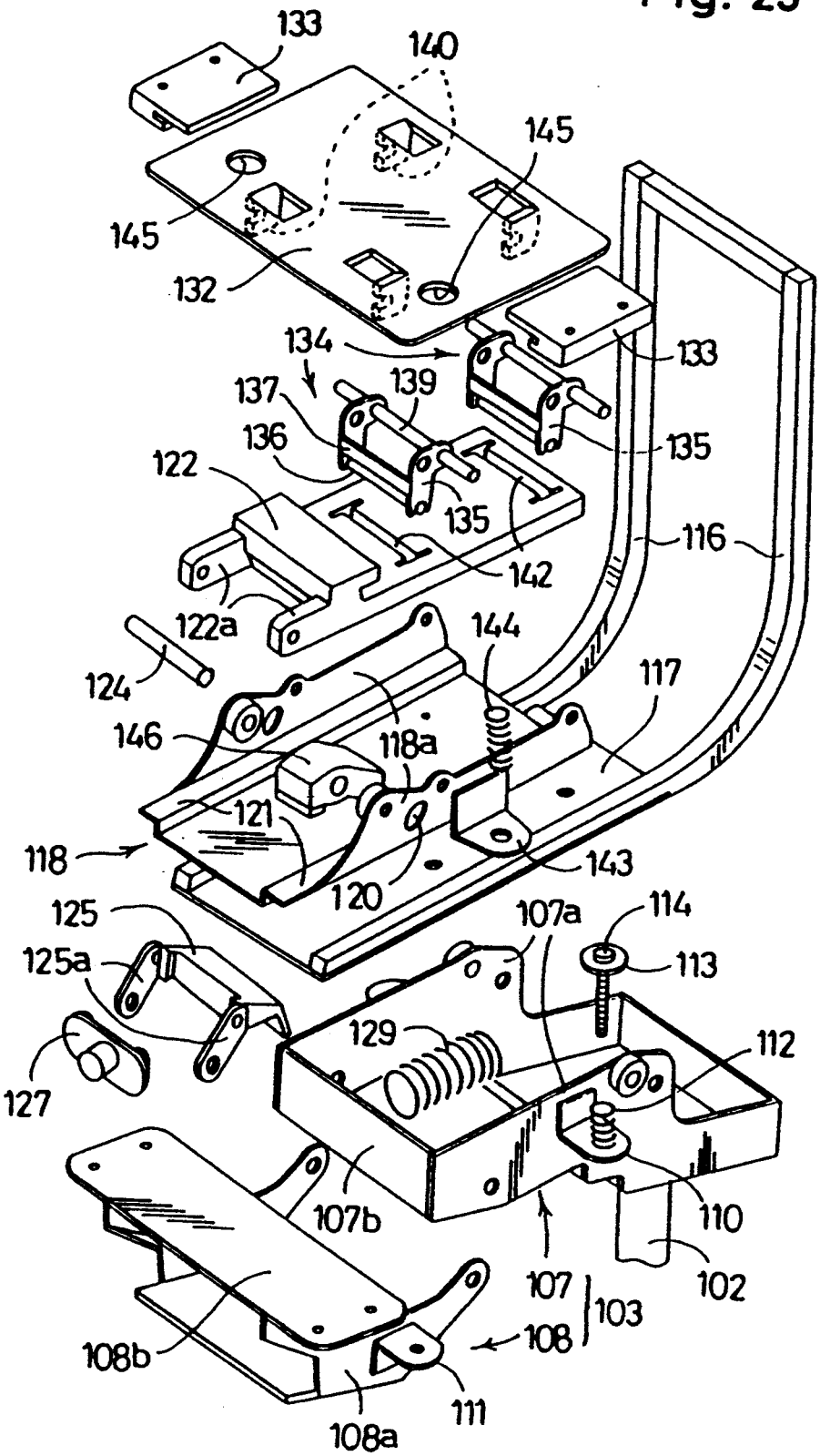
FIG. 23 is a perspective view showing the chair of FIG. 22 in an exploded state.

The chair of this embodiment, which is generally designated by reference numeral 101, comprises a support device 103 mounted to the upper end of a chair leg post 102, a seat 104 mounted on the support device 103, and a seat back 106 separate from the seat 104 and connected to the support device 103 by means of a tiltable member 105, as shown in FIG. 22.

The seat 104 includes a seat front carrier plate 104a, a seat tail carrier plate 104b, and a seat cushion 104c attached on the respective carrier plates 104a, 104b. The seat back 106 includes a back carrier plate 106a attached to the tiltable member 105, and a back cushion 106b covering the back carrier plate 106a.

As shown in FIGS. 22–25, the support device 103 comprises a fixed frame 107 fixed to the upper end of the chair leg post 102, and a forwardly pivotal frame 108 attached to the fixed frame 107. The fixed frame 107 is upwardly open, and has a pair of upturned side walls 107a and an upturned front wall 107b. The pivotal frame 108, which is also open upwardly, has a pair of upturned side walls 108a and a generally horizontal front support plate 108b attached on the respective side walls 108a. The side walls 108a of the pivotal frame 108 are pivotally connected to the respective side walls 107a of the fixed frame 107 by a first horizontal pivot 109 extending laterally of the chair. The front support plate 108b of the pivotal frame 108 is attached to the underside of the seat front carrier plate 104a.

As shown in FIGS. 22–24 and 28, each side wall 107a of the fixed frame 107 is provided, at a position ahead of the first pivot 109, with a laterally projecting first bracket 110. Similarly, each side wall 108a of the pivotal frame 108 is provided with a laterally projecting second bracket 111 corresponding to the first bracket 110. A bolt 14 having a flange 103 penetrates through the first bracket 110 and fixed to the second bracket 111. A forward tilting control spring 112 is interposed between the bolt flange 113 and the first bracket 110. Thus, the pivotal frame 108 together with the seat front carrier plate 104a is pivotable forwardly downward about the first pivot 109 against the forward tilting control spring 112.

As shown in FIGS. 22–25, 28 and 29, the tiltable member 105 includes a pair of generally L-shaped frame bars 116 having their respective lower end portions connected together by a base 117. A mechanism carrier 118 having a pair of upturned side flanges 118a is fixed on the base by screwing or welding for example. The side flanges 118a of the mechanism carrier 118 are pivotally connected to the side walls 107a of the fixed frame 107 by means of a second horizontal pivot 119. Thus, the tiltable member 105 is pivotable rearwardly downward about the second pivot 119. Indicated at 119a is a cylindrical collar fitted on the second pivot 119.

Figure 25:
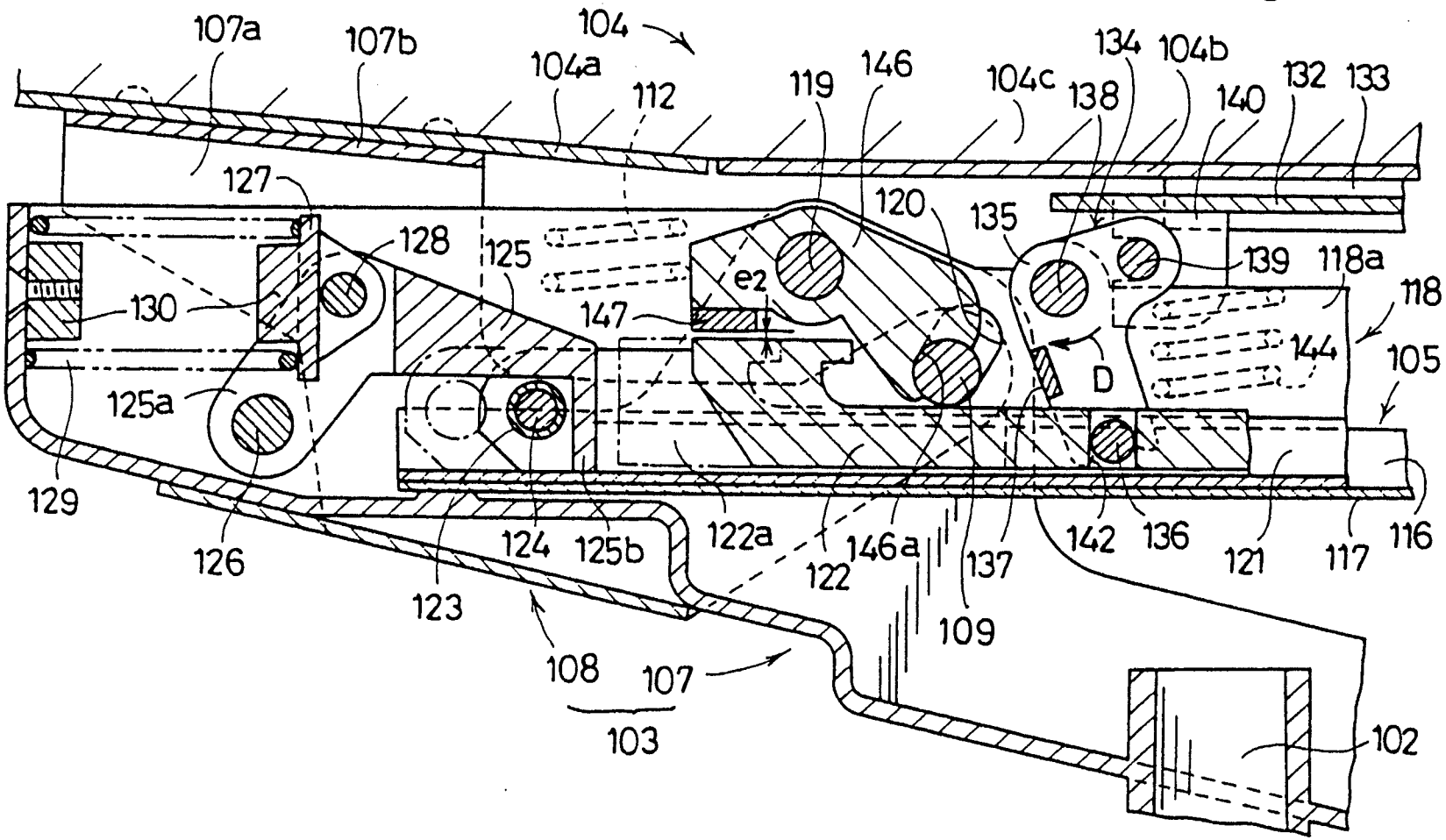
FIG. 25 is a sectional view taken along lines XXV—XXV in FIG. 24.
Figure 26:
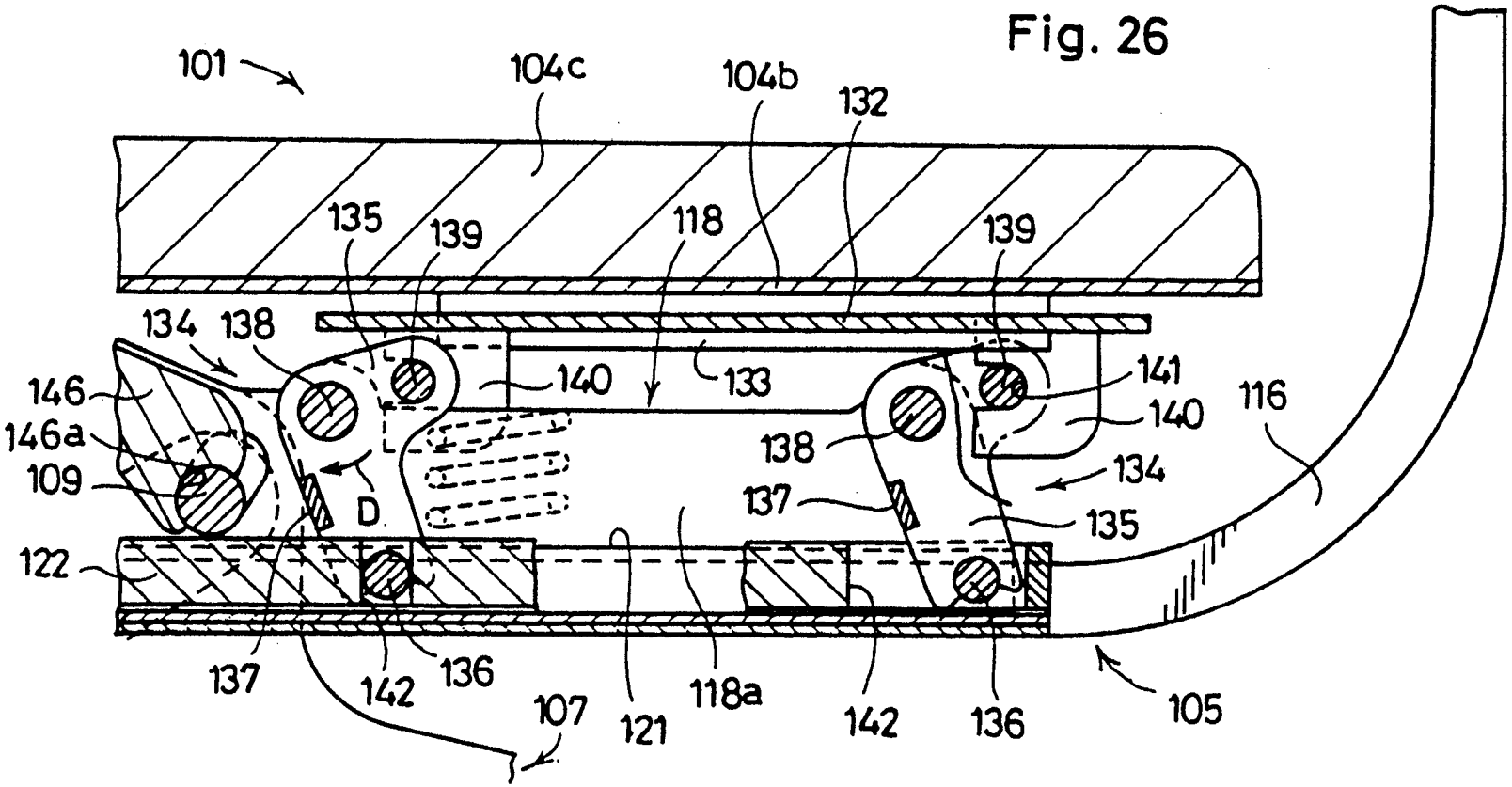
FIG. 26 is a sectional view taken along lines XXVI—XXVI in FIG. 24.
Figure 27:
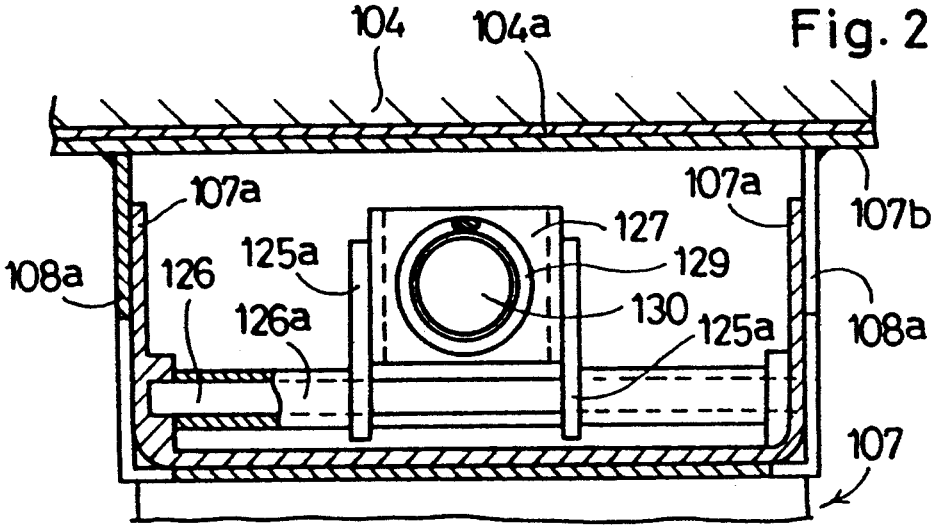
FIG. 27 is a sectional view taken along lines XXVII—XXVII in FIG. 24.
Figure 28:
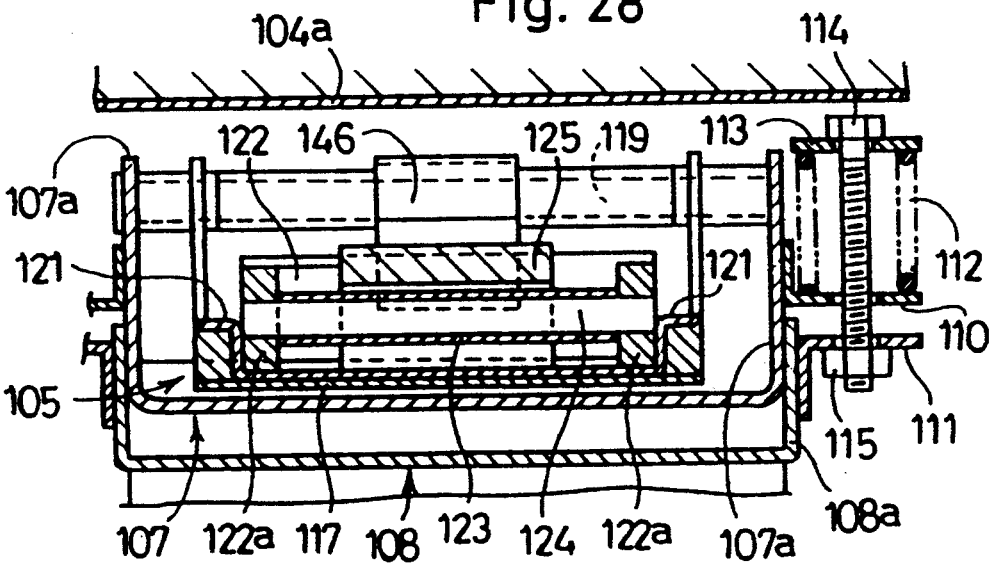
FIG. 28 is a sectional view taken along lines XXVIII—XXVIII in FIG. 24.
Figure 29:
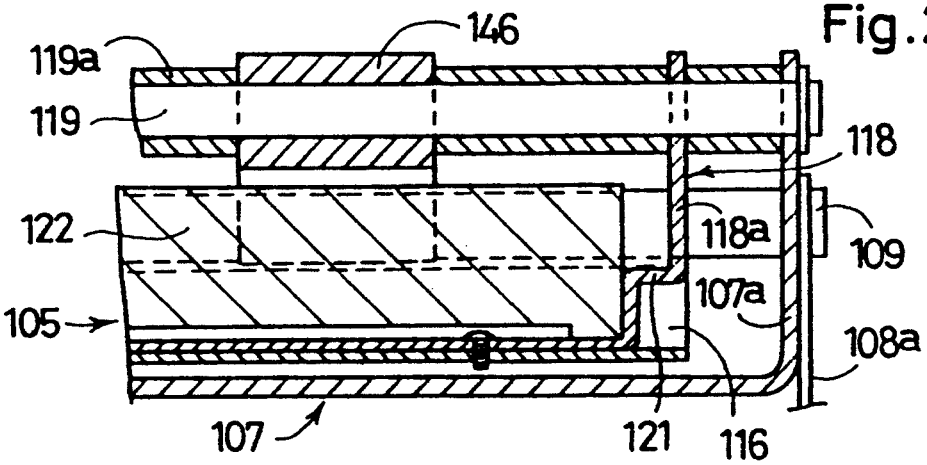
FIG. 29 is a sectional view taken along lines XXIX—XXIX in FIG. 24.

Each side flange 118a of the mechanism carrier 118 is formed with a guide hole 120 which is penetrated by the first pivot 109. As shown in FIGS. 25 and 26, the guide hole 120 is elongated in such a direction as to allow the tiltable member 105 to pivot rearwardly downward about the second pivot 119 in spite of the presence of the first pivot 109. Further, as shown in FIGS. 22 and 25, the base 117 is engageable, from above, with the fixed frame 107 at a position ahead of the second pivot 119. Thus, the tiltable member 105 is prevented from pivoting forwardly upward beyond its normal position indicated in solid lines in FIG. 22.

As shown in FIGS. 23, 25, 28, 29, 30a and 30b, the mechanism carrier 118 is provided with a pair of guide steps 121 adjacent to the respective side flanges 118a. A slider 122 is slidably mounted on the mechanism carrier 118 between the respective guide steps 121. The slider 122, which may be made of synthetic resin, has a pair of front projections 122a for carrying a load applying pin 124 provided with a load applying roller 123 (see particularly FIGS. 25 and 28). The load applying roller 123 may be omitted if desired.

As shown in FIGS. 23–25 and 27, a lever member 125 is arranged near the base 117 of the tiltable member 105 for engagement with the load applying roller 123 from above. The lever member 125 has a pair of laterally spaced front legs 125*a* extending forwardly downward for pivotal connection to the side walls 107*a* of the fixed frame 107 by means of third pivots 126. Thus, the lever member 125 is pivotable forwardly upward about the third pivots 126. Each of the third pivots 126 may be surrounded by a cylindrical collar 126*a*.

Figure 24:
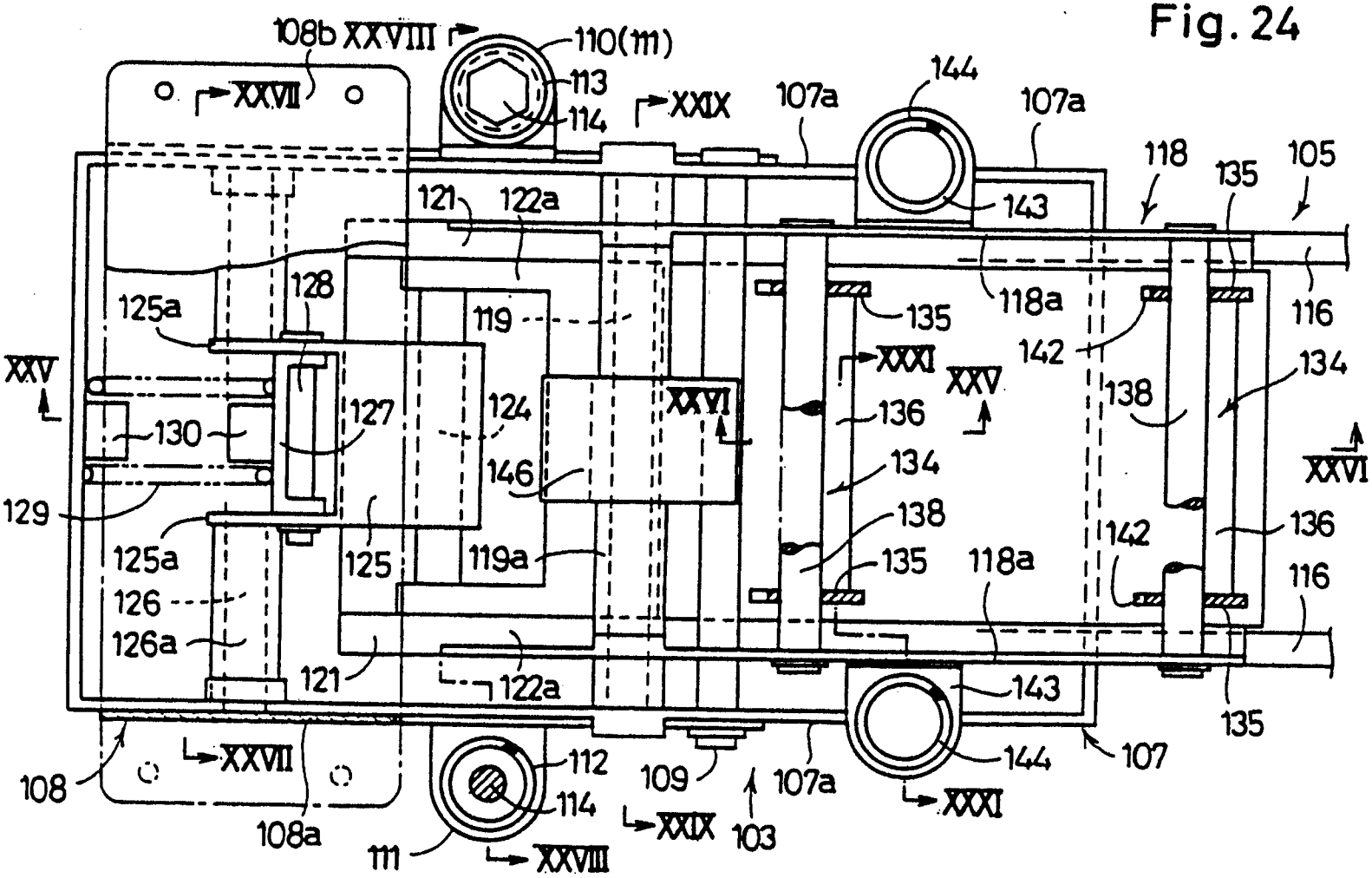
FIG. 24 is a plan view showing the chair with its seat removed.

The lever member 125 carries, at an intermediate upper portion, a pin 128 extending between the respective front legs 125*a*, and the pin 128 supports a spring seat 127. A rearward tilting control spring 129, which is in the form of a compression coil spring, is interposed between the spring seat 127 and the front wall 107*b* of the fixed frame 107. Preferably, each of the frame front wall 107*b* and spring seat 127 is provided with an anchor projection 130 for preventing accidental displacement of the tilting control spring 129 (FIGS. 24 and 25).

Figure 32:
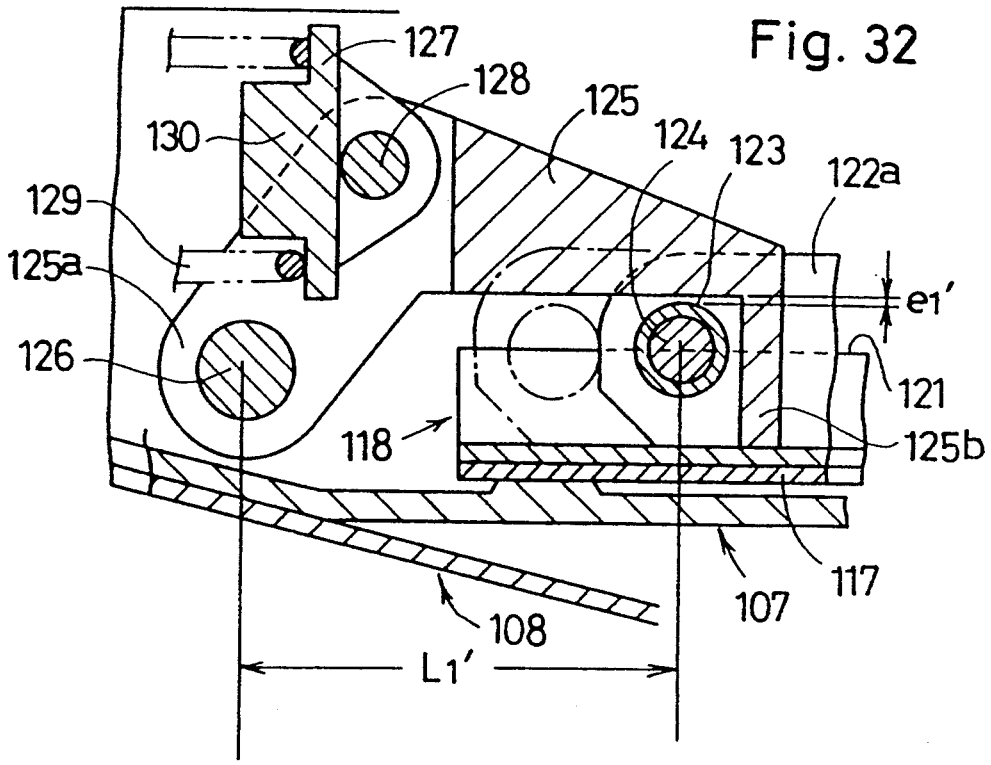
FIG. 32 is a sectional view showing a lever member incorporated in the chair of FIG. 22.

Further, as shown in FIGS. 25 and 32, the lever member 125 has a rear strut 125*b* which projects downwardly to normally rest on the bottom wall of the mechanism carrier 118. In this normal state, a small clearance el' (FIG. 32) is formed between the load applying roller 123 and the lever member 125. Thus, the slider 122 together with the load applying roller 123 (namely, the load applying pin 124) is smoothly movable relative to the lever member 125 for supportive force adjustment.

As shown in FIGS. 23, 25, 26 and 31, a pair of guide members 133 are attached to the underside of the seat tail carrier plate 104*b*, and a rear support plate 132 is slidably supported between the pair of guide members 133. A pair of link members 134 are arranged between the rear support plate 132 and the slider 122. These link members 134 together with the slider 122 forms part of a displacing mechanism.

Figure 30A:
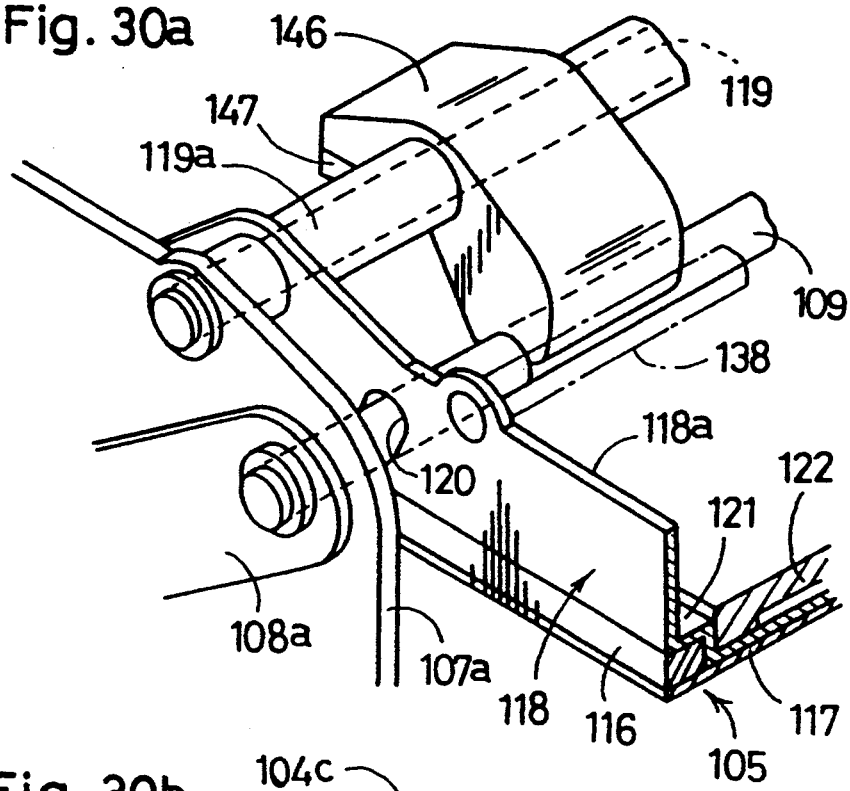
FIG. 30*a* is a fragmentary perspective view showing a lock device incorporated in the chair of FIG. 22.
Figure 30B:
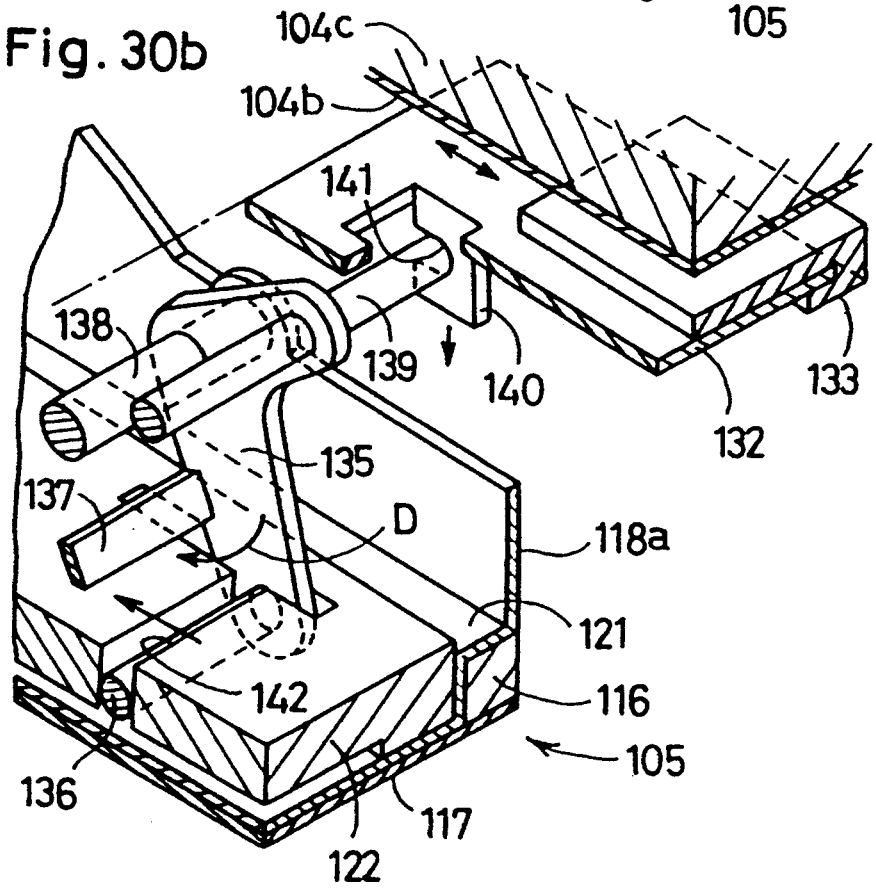
FIG. 30*b* is a fragmentary perspective view showing a displacing mechanism incorporated in the chair of FIG. 22.
Figure 31:
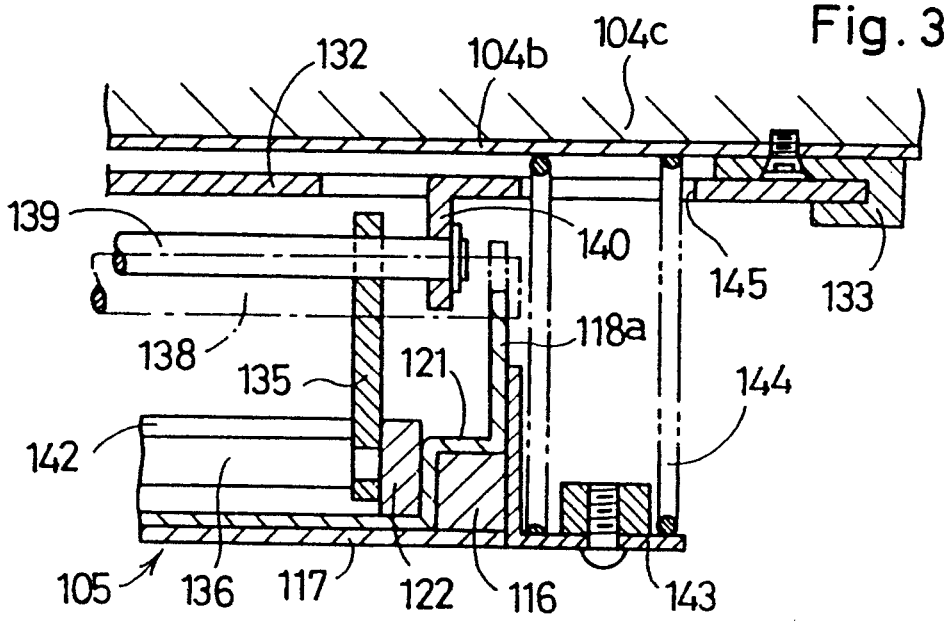
FIG. 31 is a sectional view taken along lines XXXI—XXXI in FIG. 24.

Each of the link members 134 comprises a pair of bent side links 135 integrally connected together by a connecting bar 137. The respective side links 135 are pivotally supported, at their intermediate bent portions, on the side flanges 118*a* of the mechanism carrier 118 by means of a pivot shaft 138. Further, the lower free ends of the respective side links 135 carry a first engaging pin 136 extending therebetween, whereas the upper free ends of the respective side links 135 carry a second engaging pin 139. The first engaging pin 136 is caught in a corresponding engaging groove 142 formed in the slider 122 (FIGS. 25, 26 and 30*b*).

On the other hand, the underside of the rear support plate 132 is provided with two pairs of downwardly directed engaging projections 140 in corresponding relation to the respective link members 134. Each of the engaging projections 140 is formed with a forwardly open cutout 141 (FIGS. 26 and 30*b*) for engagement with the corresponding second engaging pin 139.

As shown in FIGS. 22–24 and 31, each side flange 118*a* of the mechanism carrier 118 is provided with a third bracket 143 projecting laterally outward for supporting a weight responsive spring 144. The weight responsive spring 144, which is in the form of a compression coil spring, penetrates through a corresponding opening 145 of the rear support plate 132 and abuts against the underside of the seat tail carrier plate 104*b*. Thus, the seat tail carrier plate 104*b* together with the rear support plate 132 moves downward against the weight responsive spring 144 when the user sits on the seat 104.

As shown in FIGS. 23–25 and 30*a*, a lock member 146 is supported on the second pivot 119. The lock member 146 has a rear end formed with a catch recess 146*a* which receives the first pivot 109, so that the lock member 146 is prevented from pivoting about the second pivot 119. Further, the lock member 146 has a front end provided with a downwardly directed friction member 147 for frictional engagement with the slider 122. The friction member 147 may be made of an elastic material such as urethane rubber.

Normally, a small clearance e2 (FIG. 25) is formed between the slider 122 and the friction member 147, so that the slider 122 can smoothly move back and forth for supportive force adjustment. However, if the tiltable member 105 pivots rearwardly downward by a small amount, the friction member 147 immediately comes into frictional engagement with the slider 122 to hold it locked.

In the arrangement shown in FIG. 22, the seat tail carrier plate 104*b* is supported by the tiltable member 105 behind the second pivot 119. Thus, when the user simply sits on the seat 104, a moment is inevitably generated to pivot the tiltable member 105 rearwardly downward, which may result in premature engagement between the slider 122 and the friction member 147. To prevent such a problem, the rearward tilting control spring 129 is pre-compressed in the normal position of FIG. 22 to a degree enough to prevent, indirectly via the lever member 125, the tiltable member 105 from pivoting rearwardly downward upon a simple sitting action of the user.

In operation, when the user sits on the seat 104, the seat tail carrier plate 104*b* together with the rear support plate 132 moves downward against the weight responsive springs 144 while slightly tilting rearwardly downward. Such downward movement of the rear support plate 132 causes each of the link members 134 to pivot about the corresponding pivot shaft 138 in the direction of an arrow D in FIG. 25. As a result, the slider 122 together with the load applying pin 124 (namely, the load applying roller 123) advances to the position indicated by phantom lines in FIG. 25, and the amount of such an advancing stroke is generally proportional to the particular weight of the user. It should be appreciated that the slidability of the rear support plate 132 relative to the guide members 133 insures smooth movement of the link member 134 and slider 122.

Figure 33:
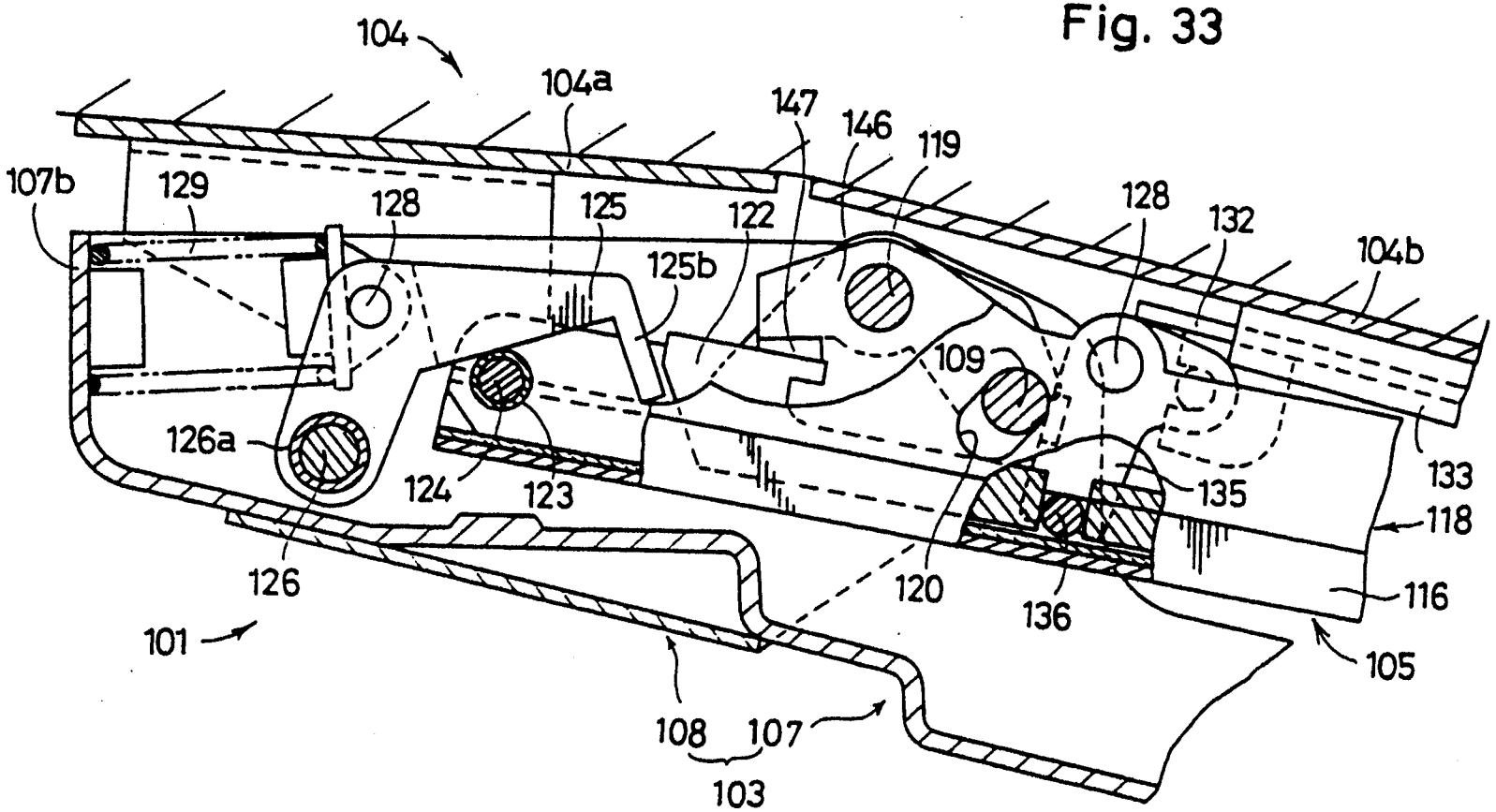
FIG. 33 is a sectional view similar to FIG. 25 but showing the same chair in its rearwardly tilted state.
Figure 34:
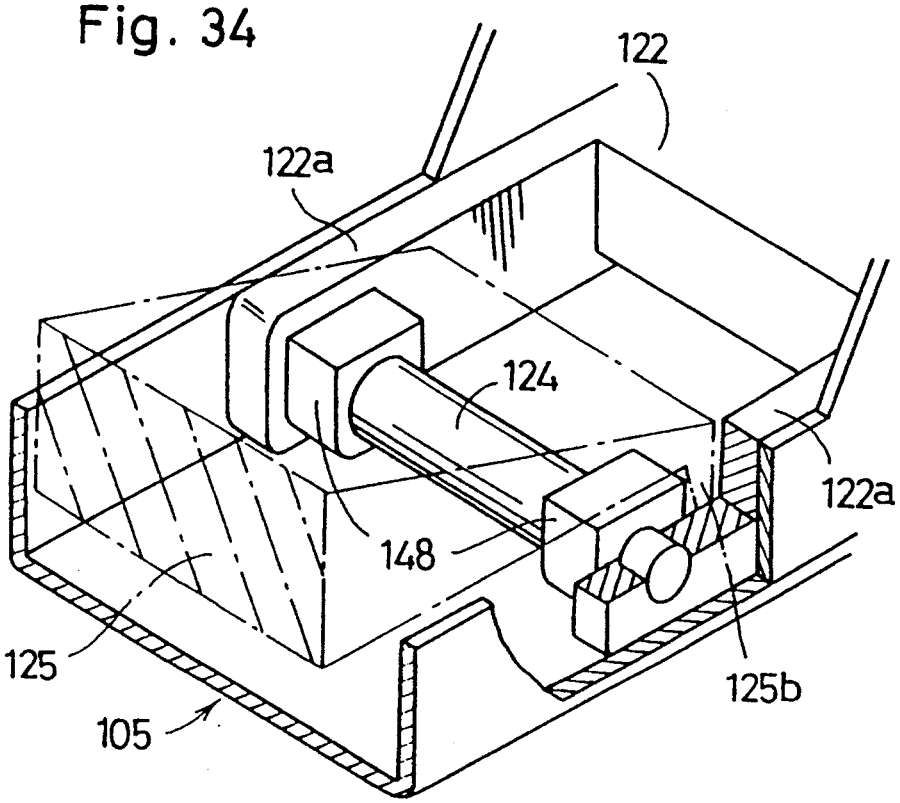
FIG. 34 is a perspective view showing a lock device according to a sixth embodiment of the present invention.
Figure 35:
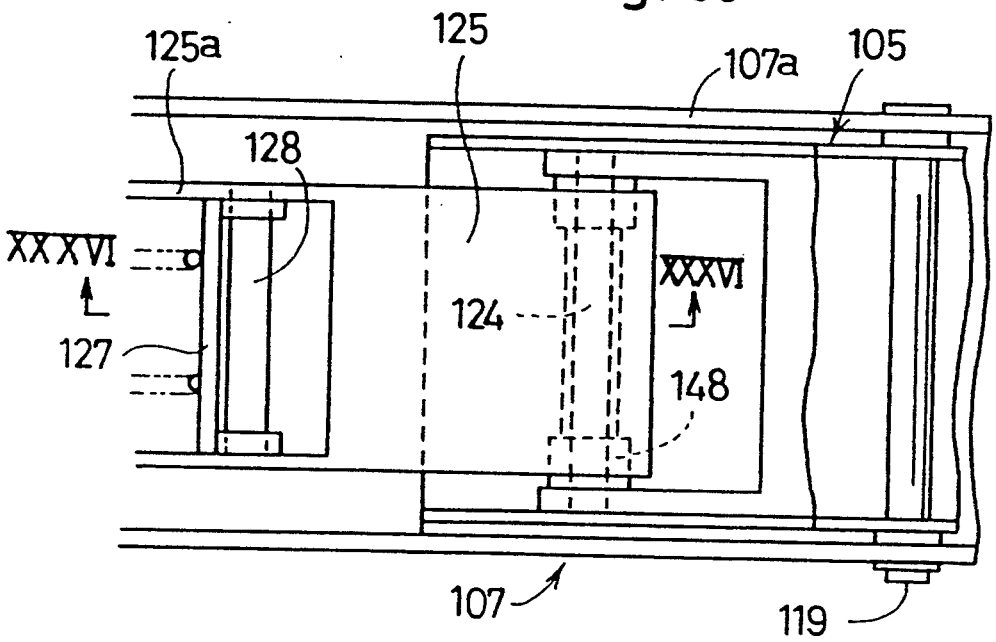
FIG. 35 is a plan view showing the lock device of FIG. 34.

In this state, if the user reclines on the seat back 106, a sufficient downward moment is generated to pivot the tiltable member 9 rearwardly downward about the second pivot 119 against the rearward tilting control spring 129, as indicated by phantom lines in FIG. 22. Such pivotal movement of the tiltable member 9 causes the slider 122 to come into frictional engagement with the friction member 147, as shown in FIG. 33. As a result, the slider 122 together with the load applying pin 124 (the load applying roller 123) is locked at a previously adjusted or displaced position while the tiltable member 105 is allowed to further pivot rearwardly downward by elastic deformation of the friction member 147.

As described above, the load applying pin 124 (the load applying roller 123) advances proportionally to the particular weight of the user. Thus, the effective arm length Li' (FIG. 32) of the lever member 125, which is defined as the distance between the third pivot 126 and the load applying pin 124, reduces progressively as the weight of the user increases. As a result, the rearward tilting control spring 129 reacts more strongly for a heavier user than for a lighter user.

When the user inclines the torso forwardly or otherwise shifts the weight forwardly, the seat front carrier plate 104*a* moves downward together with the pivotal frame 108 while tilting forwardly downward. Such forward tilting of the seat front carrier plate 104*a* is elastically controlled by the forward tilting control springs 112, as described already.

In the fifth embodiment shown in FIGS. 22–33, the lock device or member 146 is made to act on the slider 122 for holding it at an automatically adjusted position. However, a different lock device may be provided which acts on a different component (e.g. each link member 134) of the displacing mechanism for indirectly holding the slider 122.

EMBODIMENT 6

FIGS. 34 through 36*b* show a principal portion of a chair according to a sixth embodiment of the present invention. The chair of this embodiment differs from that of the fifth embodiment only in that use is made of a modified lock device.

Specifically, the modified lock device of the sixth embodiment comprises only a pair of friction members 148 mounted on the load applying pin 124 for direct contact with the lever member 125. Each of the friction members 148 may be made of an elastic material such as urethane rubber. Preferably, the friction member 148 is rectangular in cross section to provide a flat contact surface.

Figure 36A:
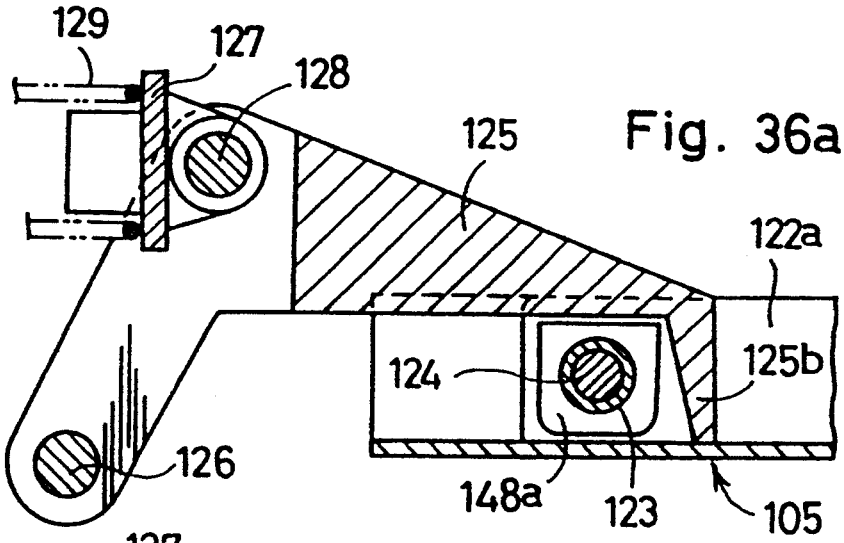
FIG. 36*a* is a sectional view taken along lines XXXVI—XXXVI in FIG. 35.

Normally, the respective friction members 148 are slightly spaced from the lever member 125, as shown in FIG. 36*a*. In this normal state, the slider 122 together with the load applying pin 124 and the friction members 148 can advance smoothly relative to the lever member 125 for automatic supportive force adjustment.

Figure 36B:
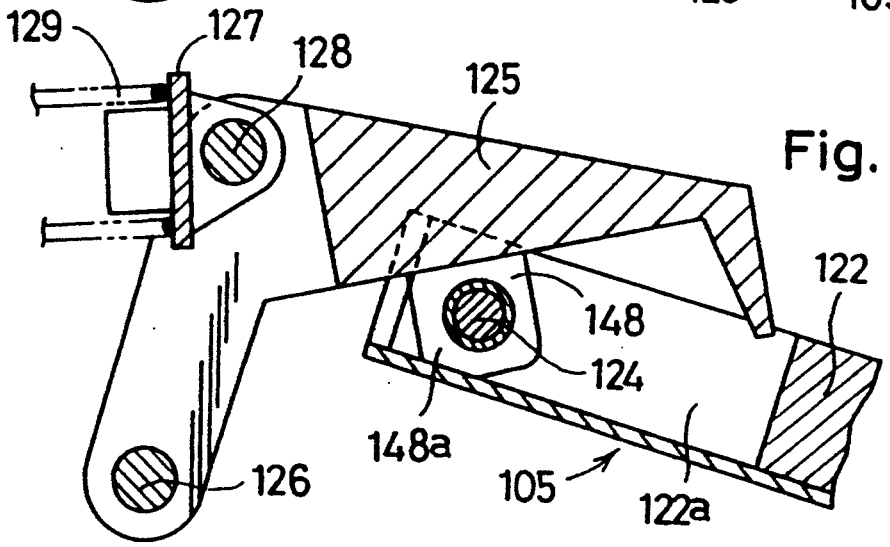
FIG. 36*b* is a sectional view similar to FIG. 36*a* but showing the same lock device after actuation.

On the other hand, when the tiltable member 105 pivots rearwardly, the friction members 148 together with the load applying pin 124 move upward to come into face-to-face frictional contact with the lever member 125, as shown in FIG. 36*b*. In this state, the slider 122 together with the load applying pin 124 and the friction members 148 is locked at an previously adjusted position. Because of the rectangular cross section, a corner portion 148*a* of each friction member 148 is compressively deformed in the locking state.

EMBODIMENT 7

Figure 37:
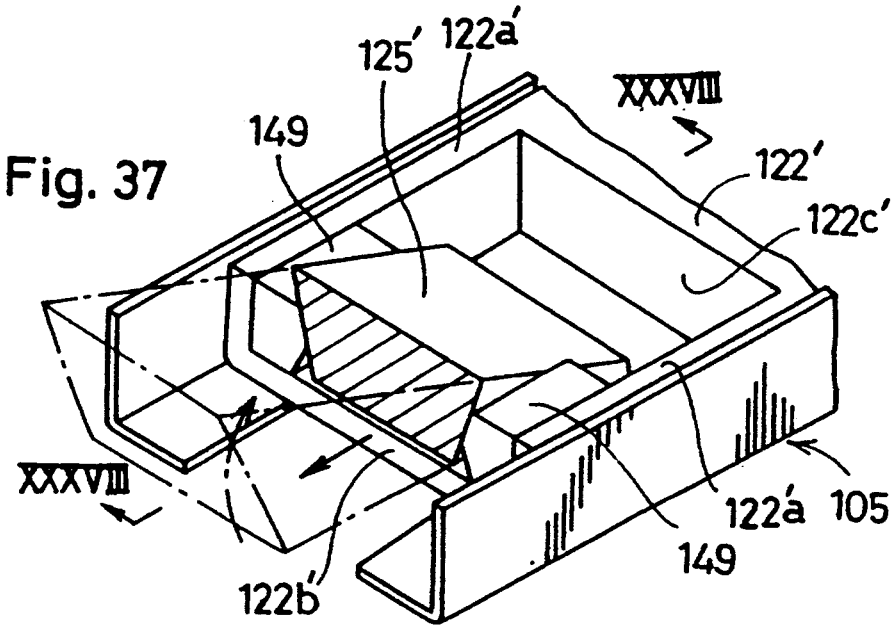
FIG. 37 is a perspective view showing a lock device according to a seventh embodiment of the present invention.
Figure 38:
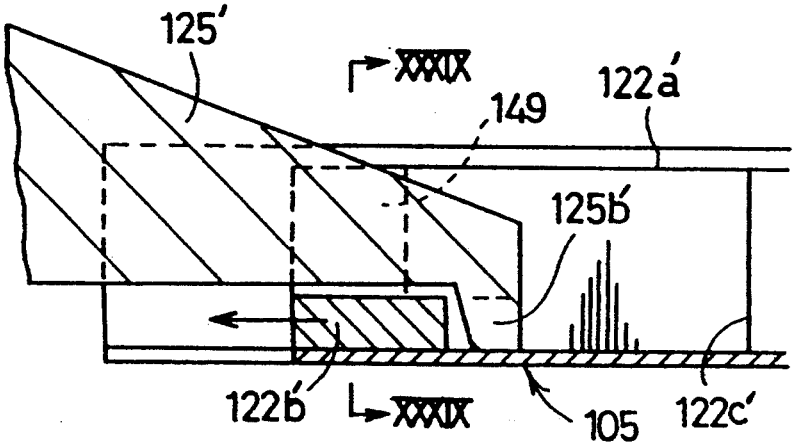
FIG. 38 is a sectional view taken along lines XXXVIII—XXXVIII in FIG. 37.
Figure 39:
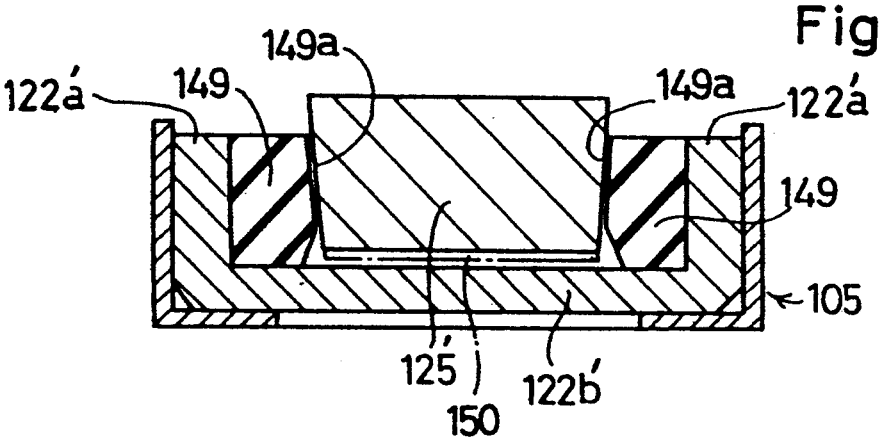
FIG. 39 is a sectional view taken along lines XXXIX—XXXIX in FIG. 38.

FIGS. 37–39 show a principal portion of a chair according to a seventh embodiment of the present invention. The chair of this embodiment also differs from that of the fifth embodiment only in that use is made of another modified lock device.

Specifically, the modified lock device of the seventh embodiment comprises only a pair of lateral friction members 149 mounted directly on a slightly modified slider 122'. The slider 122' has a pair of front projections 122*a'* connected together by a load applying bridge 122*b'* which is followed by a perforation 122*c'*. The lateral friction members 149 are mounted on the load applying bridge 122*b'* respectively adjacent to the front projections 122*a'*. The respective friction members 149 have contact surfaces 149*a* which are inclined to approach each other downwardly.

In the seventh embodiment, use is also made of a slightly modified lever member 125' for contact with the load applying bridge 122*b'* from above. The lever member 125' has a rear strut 125*b'* located in the perforation 122*c'* of the slider 122' behind the load applying bridge 122*b'*. The lever member 125' is trapezoidal in cross section, as shown in FIG. 39.

Normally, the rear strut 125*b'* of the lever member 125' rest directly on the tiltable member 105, so that the load applying bridge 122*b'* is slightly spaced from the lever member 125', as shown in FIGS. 38 and 39. Further, the contact surfaces 149*a* of the respective friction members 149 are also spaced slightly from the lever member 125', as shown in FIG. 39. Thus, in this normal state, the slider 122' together with the load applying bridge 122*b'* and the friction members 149 can advance smoothly relative to the lever member 125' for automatic supportive force adjustment.

On the other hand, when the tiltable member 105 pivots rearwardly, the friction members 149 move upward to come into face-to-face frictional contact with the lever member 125' because the lever member 125' enters deeper between the respective friction members 149. In this state, the slider 122' is frictionally locked at an previously adjusted position.

The seventh embodiment may be modified to include a friction member 150 (indicated in phantom lines in FIG. 39) attached to the lever member 125' in place of or in addition to the lateral friction members 149.

According to the third and fourth embodiments (FIGS. 18–21) described above, the lock device is actuated when the user sits on the seat, and subsequent rearward tilting of the seat back has nothing to do with the operation of the lock device. Thus, this type of lock device is advantageous in that it provides immediate adjustment of the supportive force with respect to the tilting control springs. However, if the user sits vigorously on the seat, the load applying position temporarily advances to an excessive extent with no possibility of reversing the lock device (as long as the user sits), thus failing to provide an accurate adjustment.

According to the first, second and fifth-seventh embodiments, on the other hand, the lock device is actuated only by rearward pivoting of the seat back. This type of lock device is advantageous in that locking occurs only after the actual weight of the user balances with the reaction force of the weight responsive spring or springs, so that the supportive force adjustment is always reliable.

The present invention being thus described, it is obvious that the same may be varied in many other ways. For instance, the ratchet or friction type lock device may be replaced by a clamping type lock device or other suitable lock device. Further, the entirety of the tilting control spring or springs may be rendered movable relative to the tiltable member in response to the weight of the user, as disclosed in European Patent Application Laid-open No. 0435297. Such variations are not to be regarded as a departure from the spirit and scope of the invention, and all such modifications as would be obvious to those skilled in the art are intended to be included within the scope of the following claims.

We claim:

1. A tilting control assembly for a chair, the chair comprising: support means; a seat supported above the support means; and a seat back arranged behind the seat to tilt rearwardly with a tiltable member which is pivotally connected to the support means; the tilting control assembly comprising:

tilting control spring means for elastically supporting the seat back against rearward tilting thereof via load applying means; and displacing means responsive to a downward load applied to the seat for causing relative displacement between the tilting control spring means and the load applying means in a manner such that the tilting control spring means provides a progressively larger supportive force as the downward load increases; and lock means for preventing reverse relative movement between the tilting control spring means and the load applying means at least while the seat back is rearwardly tilted;

wherein the lock means comprises ratchet gear means mounted on the tiltable member for rotation in response to the relative movement between the tilting control spring means and the load applying means, and ratchet pawl means releasably engageable with the ratchet gear means.

2. The tilting control assembly according to claim 1, wherein the displacing means comprises: first rack means movable with the seat; a pinion assembly carried by the tiltable member in mesh with the first rack means, the pinion assembly supporting the ratchet gear means for rotation therewith; and second rack means slidably mounted on the tiltable member in mesh with the pinion assembly, the second rack means carrying the load applying means.

3. The tilting control assembly control to claim 2, wherein the ratchet pawl means engages with the ratchet gear means only when the seat back is rearwardly tilted with the tiltable member.

4. The tilting control assembly according to claim 2, wherein the ratchet pawl means engages with the ratchet gear means when the seat moves downward under the downward load, the ratchet pawl means in engagement with the ratchet gear means allowing rotation of the ratchet gear means in one direction while prohibiting reverse rotation of the ratchet gear means.

5. A tilting control assembly for a chair, the chair comprising: support means; a seat supported above the support means; and seat back arranged behind the seat to tilt rearwardly with a tiltable member which is connected to the support means to pivot about a pivotal axis; the tilting control assembly comprising:

tilting control spring means for elastically supporting the seat back against rearward tilting thereof via load applying means; and displacing means responsive to a downward load applied to the seat for causing relative displacement between the tilting control spring means and the load applying means in a manner such that the tilting control spring means provides a progressively larger supportive force as the downward load increases; and lock means for preventing reverse relative movement between the tilting control spring means and the load applying means at least while the seat back is rearwardly tilted;

wherein the displacing means comprises a slider slidably mounted on the tiltable member for carrying the load applying means, the slider being pivotally moveable with the tiltable member about the pivotal axis;

wherein the lock means comprises friction means which applies a frictional locking force to the slider only when the seat back is tilted rearwardly with the tiltable member.

6. The tilting control assembly according to claim 5, wherein the friction means comprises an elastic member which is deformable for frictional engagement with the slider while also allowing further rearward tilting of the tiltable member even after frictional engagement with the slider.

7. The tilting control assembly according to claim 6, wherein the elastic member as the friction means is mounted to a lock member fixedly supported by the support means.

8. The tilting control assembly according to claim 6, wherein the elastic member as the friction means is carried by the load applying means.

9. The tilting control assembly according to claim 6, wherein the elastic member as the friction member is carried by the slider.

10. The tilting control assembly according to claim 6, wherein the load applying means acts on the tilting control spring means via a lever member, the elastic member as the friction means being carried by the lever member for contact with the load applying means.

* * * * *